US008333924B2

(12) United States Patent
Kawamura et al.

(10) Patent No.: US 8,333,924 B2
(45) Date of Patent: Dec. 18, 2012

(54) HIGH-STRENGTH AND HIGH-TOUGHNESS MAGNESIUM ALLOY AND METHOD FOR MANUFACTURING SAME

(75) Inventors: Yoshihito Kawamura, Kumamoto (JP); Michiaki Yamasaki, Kumamoto (JP); Takaomi Itoi, Chiba (JP); Mitsuji Hirohashi, Chiba (JP)

(73) Assignees: National University Corporation Kumamoto University, Kumamoto (JP); Chiba University, Chiba (JP)

( * ) Notice: Subject to any disclaimer, the term of this patent is extended or adjusted under 35 U.S.C. 154(b) by 968 days.

(21) Appl. No.: 12/225,069

(22) PCT Filed: Mar. 20, 2007

(86) PCT No.: PCT/JP2007/056522

§ 371 (c)(1),
(2), (4) Date: Sep. 23, 2008

(87) PCT Pub. No.: WO2007/111342

PCT Pub. Date: Oct. 4, 2007

(65) Prior Publication Data

US 2009/0035171 A1 Feb. 5, 2009

(30) Foreign Application Priority Data

Mar. 20, 2006 (JP) ..... 2006-077736

(51) Int. Cl.
*C22C 23/00* (2006.01)
*C22F 1/06* (2006.01)

(52) U.S. Cl. ..... 420/402; 148/420; 148/667

(58) Field of Classification Search ..... 148/420, 148/667; 420/404, 406
See application file for complete search history.

(56) References Cited

U.S. PATENT DOCUMENTS

| | | | |
|---|---|---|---|
| 5,250,124 | A | 10/1993 | Yamaguchi et al. |
| 5,304,260 | A | 4/1994 | Aikawa et al. |

FOREIGN PATENT DOCUMENTS

| | | |
|---|---|---|
| JP | 3-47941 | 2/1991 |
| JP | 4-72043 | 3/1992 |
| JP | 5-306424 | 11/1993 |
| JP | 6-81054 | 3/1994 |
| JP | 6-316740 | 11/1994 |
| WO | 2005/052203 | 6/2005 |

OTHER PUBLICATIONS

International Search Report issued Jul. 3, 2007 in the International (PCT) Application of which the present application is the U.S. National Stage.

*Primary Examiner* — Jessica L Ward
*Assistant Examiner* — Alexander Polyansky
(74) *Attorney, Agent, or Firm* — Wenderoth, Lind & Ponack, L.L.P.

(57) ABSTRACT

Provided is a high-strength and high-toughness magnesium alloy which has practical level of both the strength and the toughness for expanded applications of the magnesium alloys, and is a method for manufacturing thereof. The high-strength and high-toughness magnesium alloy of the present invention contains: a atom % in total of at least one metal of Cu, Ni, and Co; and b atom % in total of at least one element selected from the group consisting of Y, Dy, Er, Ho, Gd, Tb, and Tm, while a and b satisfying the following formulae (1) to (3), $$0.2 \leqq a \leqq 10 \quad (1)$$

$$0.2 \leqq b \leqq 10 \quad (2)$$

$$2/3a - 2/3 < b. \quad (3)$$

35 Claims, 9 Drawing Sheets

HIGH-STRENGTH AND HIGH-TOUGHNESS MAGNESIUM ALLOY AND METHOD FOR MANUFACTURING SAME

TECHNICAL FIELD

The present invention relates to a high-strength and high-toughness magnesium alloy and a method for manufacturing thereof, more particularly to a high-strength and high-toughness magnesium alloy which attained the high strength and high toughness by containing a specific amount of specified rare-earth element thereto, and to a method for manufacturing thereof.

BACKGROUND ART

Magnesium alloys have begun to be rapidly in widespread use as casing of cell phones or laptop computers, and as automobile parts, along with the recycling performance thereof.

To be used for these uses, however, the magnesium alloys are required to have high strength and high toughness. For the manufacture of high-strength and high-toughness magnesium alloy, various studies have been conducted from the viewpoint of materials and the like.

According to a disclosure of the inventors of the present invention, an ingot of magnesium alloy having a composition of 97 atom % Mg-1 atom % Zn-2 atom % Y forms a long-period stacking ordered structure therein, and high strength and high toughness are obtained at room temperature by applying extrusion working to the ingot, (for example, refer to Patent Document 1).

[Patent Document 1] WO 2005/052203

DISCLOSURE OF THE INVENTION

Above-described conventional high-strength and high-roughness magnesium alloys are essential requirements for containing Zn therein. To this point, the inventors of the present invention have studied whether a magnesium alloy, in which Zn is substituted with other metal, can provide high strength and high toughness.

The present invention has been perfected taking into account the above situations, and an object of the present invention is to provide a high-strength and high-toughness magnesium alloy which has practical level of both the strength and the toughness for expanded applications of the magnesium alloys, and to provide a method for manufacturing thereof.

To solve the above problems, the high-strength and high-toughness magnesium alloy in the present invention contains: a atom % in total of at least one metal of Cu, Ni, and Co; and b atom % in total of at least one element selected from the group consisting of Y, Dy, Er, Ho, Gd, Tb, and Tm, while a and b satisfying the following formulae (1) to (3), and more preferably a and b satisfying the following formulae (1') to (3'), $$0.2 \leqq a \leqq 10 \quad (1)$$

$$0.2 \leqq b \leqq 10 \quad (2)$$

$$2/3a - 2/3 < b \quad (3)$$

$$0.2 \leqq a \leqq 5 \quad (1')$$

$$0.2 \leqq b \leqq 5 \quad (2')$$

$$2/3a - 1/6 < b. \quad (3')$$

The high-strength and high-toughness magnesium alloy in the present invention can also have a long-period stacking ordered structure phase.

The high-strength and high-toughness magnesium alloy in the present invention can also have an α-Mg phase, and the α-Mg phase can also have a lamellar structure.

The high-strength and high-toughness magnesium alloy in the present invention can also have a compound phase.

The high-strength and high-toughness magnesium alloy in the present invention is a magnesium alloy cast, and the magnesium alloy cast can also be heat-treated.

The high-strength and high-toughness magnesium alloy in the present invention can also be a plastic work product obtained by applying plastic-working of the magnesium alloy cast.

The high-strength and high-toughness magnesium alloy in the present invention is composed of a plastic work product having a long-period stacking ordered structure phase, which plastic work product is manufactured by preparing a magnesium alloy cast having a atom % in total of at least one metal of Cu, Ni, and Co, and b atom % in total of at least one element selected from the group consisting of Y, Dy, Er, Ho, Gd, Tb, and Tm, while a and b satisfying the following formulae (1) to (3), then by cutting the magnesium alloy cast into chip-shaped casts, and then by solidifying the casts by plastic-working, and preferably is manufactured thereby while a and b satisfying the following formulae (1') to (3'), $$0.2 \leqq a \leqq 10 \quad (1)$$

$$0.2 \leqq b \leqq 10 \quad (2)$$

$$2/3a - 2/3 < b \quad (3)$$

$$0.2 \leqq a \leqq 5 \quad (1')$$

$$0.2 \leqq b \leqq 5 \quad (2')$$

$$2/3a - 1/6 < b. \quad (3')$$

The high-strength and high-toughness magnesium alloy in the present invention is composed of a plastic work product having a long-period stacking ordered structure phase, which plastic work product is manufactured by preparing a magnesium alloy cast having a atom % in total of at least one metal of Cu, Ni, and Co, and b atom % in total of at least one element selected from the group consisting of Y, Dy, Er, Ho, Gd, Tb, and Tm, while a and b satisfying the following formulae (1) to (3), then by carrying out plastic-working of the magnesium alloy cast, and preferably is manufactured thereby while a and b satisfying the following formulae (1') to (3'), $$0.2 \leqq a \leqq 10 \quad (1)$$

$$0.2 \leqq b \leqq 10 \quad (2)$$

$$2/3a - 2/3 < b \quad (3)$$

$$0.2 \leqq a \leqq 5 \quad (1')$$

$$0.2 \leqq b \leqq 5 \quad (2')$$

$$2/3a - 1/6 < b. \quad (3')$$

Regarding the high-strength and high-toughness magnesium alloy in the present invention, the high-strength and high-toughness magnesium alloy can also be heat-treated.

Regarding the high-strength and high-toughness magnesium alloy in the present invention, the plastic work product can also be heat-treated.

Regarding the high-strength and high-toughness magnesium alloy in the present invention, the plastic work product can have an α-Mg phase, and the α-Mg phase can have a lamellar structure.

Regarding the high-strength and high-toughness magnesium alloy in the present invention, the plastic work product can also have a compound phase.

Regarding the high-strength and high-toughness magnesium alloy in the present invention, the plastic-working preferably includes at least one of rolling, extruding, ECAE, drawing, forging, pressing, form-rolling, bending, FSW working, and repeating thereof.

Regarding the high-strength and high-toughness magnesium alloy in the present invention, the plastic-working preferably gives an amount of equivalent strain per at least one cycle thereof within the range of more than zero to not more than 5.

The high-strength and high-toughness magnesium alloy in the present invention is composed of a powder, a sheet, or a thin wire, which is prepared by forming a liquid having a composition containing a atom % in total of at least one metal of Cu, Ni, and Co, and b atom % in total of at least one element selected from the group consisting of Y, Dy, Er, Ho, Gd, Tb, and Tm, with a and b satisfying the following formulae (1) to (3), then by rapidly cooling the liquid to coagulate, and more preferably by forming a liquid having a composition in which a and b satisfy the following formulae (1') to (3'), $$0.2 \leqq a \leqq 10 \quad (1)$$

$$0.2 \leqq b \leqq 10 \quad (2)$$

$$2/3a - 2/3 < b \quad (3)$$

$$0.2 \leqq a \leqq 5 \quad (1')$$

$$0.2 \leqq b \leqq 5 \quad (2')$$

$$2/3a - 1/6 < b. \quad (3')$$

Regarding the high-strength and high-toughness magnesium alloy in the present invention, the powder, the sheet, or the thin wire can also have a crystal structure of long-period stacking ordered structure phase.

Regarding the high-strength and high-toughness magnesium alloy in the present invention, the powder, the sheet, or the thin wire can also have an α-Mg phase, and the α-Mg phase can also have a lamellar structure.

Regarding the high-strength and high-toughness magnesium alloy in the present invention, the powder, the sheet, or the thin wire can also have a compound phase.

Regarding the high-strength and high-toughness magnesium alloy in the present invention, the powder, the sheet, or the thin wire can also be the one solidified so that shear is applied thereto.

Regarding the high-strength and high-toughness magnesium alloy in the present invention, the long-period stacking ordered structure phase can also kink.

Regarding the high-strength and high-toughness magnesium alloy in the present invention, the Mg can be added with c atom % of Zn, while the a and c can also satisfy the following formula (4), and more preferably the a and c satisfy the following formula (4'), $$0.2 < a + c \leqq 15 \quad (4)$$

$$0.2 < a + c \leqq 5. \quad (4')$$

Regarding the high-strength and high-toughness magnesium alloy in the present invention, the a and c can also further satisfy the following formula (5), $$c/a \leqq 1/2. \quad (5)$$

Regarding the high-strength and high-toughness magnesium alloy in the present invention, the Mg can also be added with d atom % in total of at least one element selected from the group consisting of La, Ce, Pr, Nd, Sm, Eu, Yb, and Lu, while the b and d can also satisfy the following formula (6), and more preferably the b and d satisfy the following formula (6'), $$0.2 < b + d \leqq 15 \quad (6)$$

$$0.2 < b + d \leqq 5. \quad (6')$$

Regarding the high-strength and high-toughness magnesium alloy in the present invention, b and d can also further satisfy the following formula (7), $$d/b \leqq 1/2. \quad (7)$$

Regarding the high-strength and high-toughness magnesium alloy in the present invention, the Mg can also be added with e atom % in total of at least one element selected from the group consisting of Zr, Ti, Mn, Al, Ag, Sc, Sr, Ca, Si, Hf, Nb, B, C, Sn, Au, Ba, Ge, Bi, Ga, In, Ir, Li, Pd, Sb, V, Fe, Cr, and Mo, while e can satisfy the following formula (8), $$0 < e \leqq 2.5. \quad (8)$$

Regarding the high-strength and high-toughness magnesium alloy in the present invention, e, a, b, and d can also further satisfy the following formula (9), $$e/(a+b+c+d) \leqq 1/2. \quad (9)$$

The method for manufacturing high-strength and high-toughness magnesium alloy in the present invention has the steps of: preparing a magnesium alloy cast containing a atom % in total of at least one metal of Cu, Ni, and Co, and b atom % in total of at least one element selected from the group consisting of Y, Dy, Er, Ho, Gd, Tb, and Tm, while a and b satisfying the following formulae (1) to (3); and preparing a plastic work product by carrying out plastic-working of the magnesium alloy cast, and more preferably has the step of preparing a magnesium alloy cast in which a and b satisfy the following formulae (1') to (3'), $$0.2 \leqq a \leqq 10 \quad (1)$$

$$0.2 \leqq b \leqq 10 \quad (2)$$

$$2/3a - 2/3 < b \quad (3)$$

$$0.2 \leqq a \leqq 5 \quad (1')$$

$$0.2 \leqq b \leqq 5 \quad (2')$$

$$2/3a - 1/6 < b. \quad (3')$$

The high-strength and high-toughness magnesium alloy in the present invention can also further have the step of cutting the magnesium alloy cast between the step of preparing the magnesium alloy cast and the step of preparing the plastic work product.

The method for manufacturing high-strength and high-toughness magnesium alloy in to the present invention can also further comprise the step of conducting heat treatment of the magnesium alloy cast after the step of preparing the magnesium alloy cast.

The method for manufacturing high-strength and high-toughness in the present invention can also further comprise the step of conducting heat treatment of the plastic work product after the step of preparing the plastic work product.

The method for manufacturing high-strength and high-toughness magnesium alloy in the present invention has the steps of: preparing a liquid having a composition containing a atom % in total of at least one metal of Cu, Ni, and Co, and b atom % in total of at least one element selected from the group consisting of Y, Dy, Er, Ho, Gd, Tb, and Tm, while a and b satisfying the following formulae (1) to (3); and forming a powder, a sheet, or a thin wire by rapidly cooling the liquid to coagulate, then by solidifying the powder, the sheet, or the thin wire so that shear is applied thereto, and more preferably preparing a liquid having a composition in which a an b satisfy the following formulae (1') to (3'), $$0.2 \leqq a \leqq 10 \quad (1)$$

$$0.2 \leqq b \leqq 10 \quad (2)$$

$$2/3a - 2/3 < b \quad (3)$$

$$0.2 \leqq a \leqq 5 \quad (1')$$

$$0.2 \leqq b \leqq 5 \quad (2')$$

$$2/3a - 1/6 < b. \quad (3')$$

As described above, the present invention can provide a high-strength and high-toughness magnesium alloy which has practical level of both the strength and the toughness for expanded applications of the magnesium alloys, and to provide a method for manufacturing thereof.

DESCRIPTION OF THE REFERENCE SYMBOLS

Figure 1:
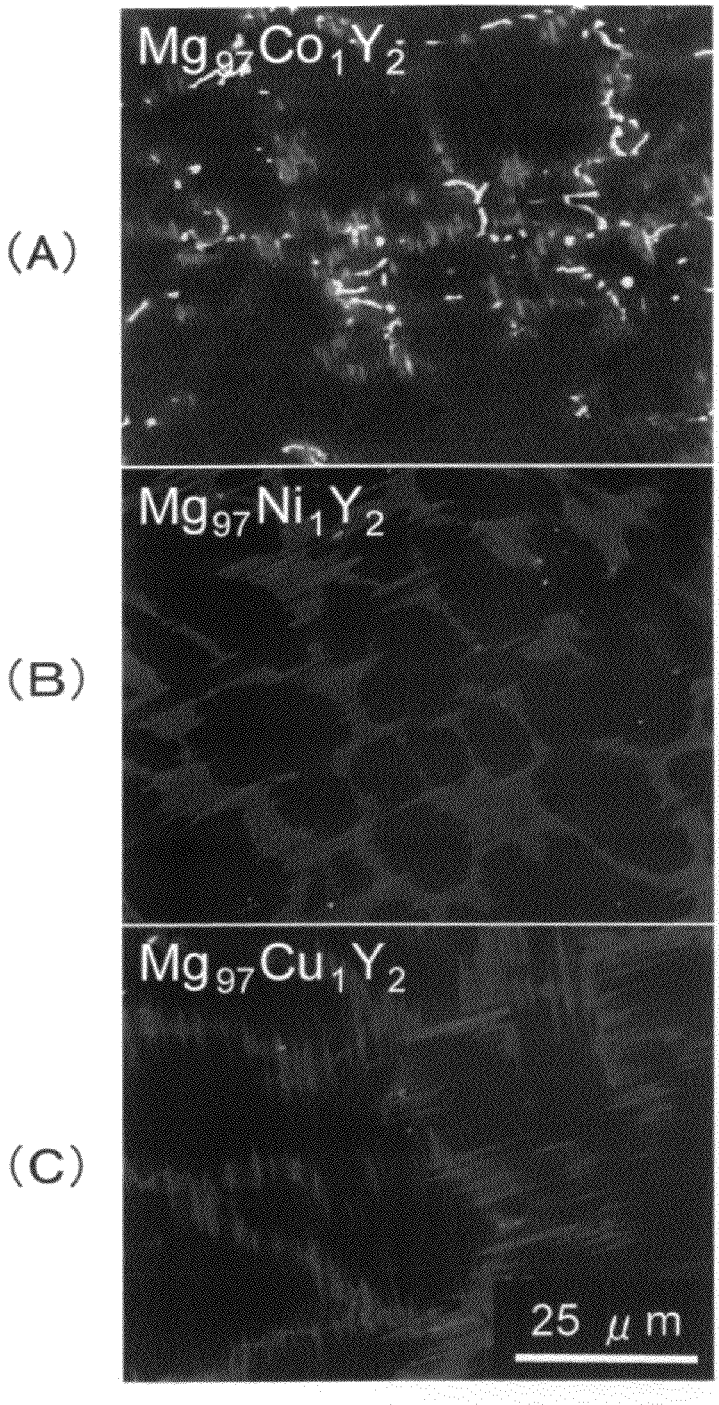
FIG. 1(A) is an SEM micrograph of an ingot of $Mg_{97}Co_1Y_2$ alloy.
FIG. 1(B) is an SEM micrograph of an ingot of $Mg_{97}Ni_1Y_2$ alloy.
FIG. 1(C) is an SEM micrograph of an ingot of $Mg_{97}Cu_1Y_2$ alloy.

| | |
|---|---|
| 100 | high pressure gas atomizer |
| 110 | melting chamber |
| 112 | stopper |
| 114 | induction coil |
| 116 | crucible |
| 130 | atomizing chamber |
| 131 | heater |
| 132 | nozzle |
| 140 | cyclone classifier |
| 150 | filter |
| 162, 166 | oxygen analyzer |
| 164 | vacuum gauge |
| 200 | vacuum glove box |
| 210 | argon gas refiner |
| 220 | hopper |
| 230 | sieve |
| 240 | vacuum hot press |
| 242 | vacuum chamber |
| 244 | punch |
| 246 | die |
| 248 | heater |
| 252 | cap |
| 254 | can |
| 256 | welding machine |
| 258 | rotary disk |
| 260 | billet |
| 262 | valve |
| 270 | oxidation box |
| 280 | entrance box |
| 292 | vacuum gauge |
| 294 | hygrometer |
| 296 | oxygen analyzer |
| 340 | spot-welding machine |
| 400 | extrusion press |
| 410 | heater |
| 420 | container |
| 430 | die |
| 450 | main stem |
| 460 | die backer |
| 470 | back stem |

BEST MODE FOR CARRYING OUT THE INVENTION

The embodiments of the present invention are described below.

The inventors of the present invention have substituted Zn in Mg—Zn-RE (rare earth element) alloys with other metals, and investigated strength and toughness thereof, and found that there are attained magnesium alloys having high level of both the strength and the toughness even when Zn is substituted with other metals, and also found that there are attained higher strength and toughness than ever with the magnesium alloys of a series of Mg-(substituted metal)-RE (rare earth element), in which the substituted metal is at least one metal of Cu, Ni, and Co, and the rare earth element is at least one element selected from the group consisting of Y, Dy, Er, Ho, Gd, Tb, and Tm, and further the content of the substituted metal is as low as 5 atom % or less, and the content of the rare earth element is as low as 5 atom % or less.

The inventors of the present invention have further found that plastic-working of a metal having a long-period stacking ordered structure phase can curve or bend at least a part of the long-period stacking ordered structure phase, thereby obtaining a metal having high strength, high ductility, and high toughness.

The inventors of the present invention have found that a cast alloy forming a long-period stacking ordered structure phase provides a magnesium alloy having high strength, high ductility, and high toughness, after plastic-working or by conducting heat treatment after plastic-working. Also the inventors of the present invention have found an alloy composition which forms a long-period stacking ordered structure and provides high strength, high ductility, and high toughness after plastic-working, or after both plastic-working and subsequent heat treatment.

Furthermore, the inventors of the present invention have found that even an alloy which does not form a long-period stacking structure phase in a state immediately after casting, forms a long-period stacking structure phase by conducting heat treatment to the alloy. The inventors of the present invention have found an alloy composition which provides high strength, high ductility, and high toughness by carrying out plastic-working or by conducting heat treatment after plastic-working thereof.

Furthermore, it was found that, by preparing chip-shaped casts by cutting a cast alloy in which a long-period stacking ordered structure is formed, and by carrying out plastic-working thereof or by conducting heat treatment thereof after plastic-working, there is attained a magnesium alloy having higher strength, higher ductility, and higher toughness, compared with the case where a process of cutting into chip-shape in not conducted. Further, the inventors of the present invention have found an alloy composition which provides high strength, high ductility, and high toughness by forming a long-period stacking ordered structure, by cutting the alloy in chip shape, and then carrying out plastic-working or by conducting heat treatment after plastic-working thereof.

Embodiment 1

The magnesium alloy according to the Embodiment 1 of the present invention is an alloy of ternary or higher order, containing at least one metal of Cu, Ni, and Co, and containing rare earth elements that are one or more elements selected from the group consisting of Y, Dy, Er, Ho, Gd, Tb, and Tm.

The composition range of the magnesium alloy according to the Embodiment 1 is the one in which a and b satisfy the following formulae (1) to (3), and more preferably a and b satisfy the following formulae (1') to (3'), (the total content of the above-described one metal is defined as a atom %, while the total content of the above-described one or more rare earth elements is defined as b atom %), $$0.2 \leqq a \leqq 10 \quad (1)$$

$$0.2 \leqq b \leqq 10 \quad (2)$$

$$2/3a - 2/3 < b \quad (3)$$

$$0.2 \leqq a \leqq 5 \quad (1')$$

$$0.2 \leqq b \leqq 5 \quad (2')$$

$$2/3a - 1/6 < b. \quad (3')$$

The reason of above is that, if the total content of above-described one metal exceeds 10 atom %, specifically the toughness (or the ductility) tends to decrease, and that, if the total content of the rare earth elements exceeds 10 atom %, specifically the toughness (or the ductility) tends to decrease.

If the total content of above-described one metal is less than 0.2 atom %, or if the total content of the rare earth elements is less than 0.2 atom %, at least any of the strength and the toughness becomes insufficient. Therefore, the lower limit of the total content of the above-described one metal is specified to 0.2 atom %, and the lower limit of the total content of the rare earth elements is specified to 0.2 atom %.

In the magnesium alloy according to the Embodiment 1, the component other than the above-described one metal and the rare earth element, having the above-mentioned range of content, is magnesium. However, the magnesium alloy may contain amounts of impurities not affecting the alloy characteristics.

Embodiment 2

The magnesium alloy according to the Embodiment 2 of the present invention is the one in which the composition of the Embodiment 1 contains Zn.

That is, the magnesium alloy according to the Embodiment 2 is one of quaternary or higher order, containing at least one metal of Cu, Ni, and Co, and Zn, and rare earth elements that are one or more elements selected from the group consisting of Y, Dy, Er, Ho, Gd, Tb, and Tm.

The composition range of the magnesium alloy according to the Embodiment 2 is the one in which a, b, and c satisfy the following formulae (1) to (3), and preferably a, b, and c satisfy the following formulae (1') to (3'), (the total content of above-described one metal is defined as a atom %, the total content of the above-described one or more rare earth elements is defined as b atom %, and the content of Zn is defined as c atom %), $$0.2 \leqq a + c \leqq 15 \quad (1)$$

$$0.2 \leqq b \leqq 10 \quad (2)$$

$$2/3a - 2/3 < b \quad (3)$$

$$0.2 < a + c \leqq 5 \quad (1')$$

$$0.2 \leqq b \leqq 5 \quad (2')$$

$$2/3a - 1/6 < b. \quad (3')$$

More preferably, the composition range thereof is the one in which a, b, and c satisfy the following formulae (1) to (4), and most preferably a, b, and c satisfy the following formulae (1') to (4'), $$0.2 \leqq a + b \leqq 15 \quad (1)$$

$$0.2 \leqq b \leqq 10 \quad (2)$$

$$2/3a - 2/3 < b \quad (3)$$

$$c/a \leqq 1/2 \quad (4)$$

$$0.2 < a + c \leqq 5 \quad (1')$$

$$0.2 \leqq b \leqq 5 \quad (2')$$

$$2/3a - 1/6 < b \quad (3')$$

$$c/a \leqq 1/2. \quad (4')$$

The reason of above is that, if the total content of the above-described one metal and Zn exceeds 15 atom %, specifically the toughness (or the ductility) tends to decrease, and if the total content of the rare earth elements exceeds 10 atoms, specifically the toughness (or the ductility) tends to decrease.

Further, if the total content of the above-described one metal and Zn is less than 0.2 atom %, or if the total content of the rare earth elements is less than 0.2 atom %, at least any of the strength and the toughness becomes insufficient. Therefore, the lower limit of the total content of above-described one metal and Zn is specified to 0.2 atom %, and the lower limit of the total content of the rare earth elements is specified to 0.2 atoms.

In the magnesium alloy according to the Embodiment 2, the component other than the above-described one metal and the rare earth elements, having the above-mentioned range of content, is magnesium. However, the magnesium alloy may contain amounts of impurities not affecting the alloy characteristics.

Embodiment 3

The magnesium alloy according to the Embodiment 3 of the present invention is the one in which the composition of the Embodiment 1 contains one or more elements selected from the group consisting of La, Ce, Pr, Nd, Sm, Eu, Yb, and Lu.

That is, the magnesium alloy according to the Embodiment 3 is one of quaternary or higher order, containing at least one metal of Cu, Ni, and Co, and containing first rare earth elements and second rare earth elements, in which first rare earth elements are one or more elements selected from the group consisting of Y, Dy, Er, Ho, Gd, Tb, and Tm, and in which second rare earth elements are one or more elements selected from the group consisting of La, Ce, Pr, Nd, Sm, Eu, Yb, and Lu.

The composition range of the magnesium alloy according to the Embodiment 3 is the one in which a, b, and d satisfy the following formulae (1) to (3), and more preferably a, b, and d satisfy the following formulae (1') to (3'), (the total content of the above-described one metal is defined as a atom %, the total content of the above-described one or more of the first rare earth element is defined as b atom %, and the total content of the above-described one or more of the second rare earth elements is defined as d atom %), $$0.2 \leqq a \leqq 10 \quad (1)$$

$$0.2 < b+d \leqq 15 \quad (2)$$

$$2/3a - 2/3 < b \quad (3)$$

$$0.2 \leqq a \leqq 5 \quad (1')$$

$$0.2 < b+d \leqq 5 \quad (2')$$

$$0.2 < b+d \leqq 5. \quad (3')$$

The reason of above is that, if the total content of the first rare earth elements and the second rare earth elements exceeds 15 atom %, specifically the toughness (or the ductility) tends to decrease. The reason for adding the second rare earth elements is that the second rare earth elements have an effect of refining crystal grains and have an effect of precipitating intermetallic compounds.

If the total content of the first rare earth elements and the second rare earth elements is less than 0.2 atom %, at least any of the strength and the toughness becomes insufficient. Therefore, the lower limit of the total content of the first rare earth elements and the second rare earth elements is specified to 0.2 atom %.

The reason for specifying the content of the above-described one metal as above is similar to that of the Embodiment 1.

Embodiment 4

The magnesium alloy according to the Embodiment 4 of the present invention is the one in which the composition of the Embodiment 2 contains one or more element selected from the group consisting of La, Ce, Pr, Nd, Sm, Eu, Yb, and Lu.

That is, the magnesium alloy according to the Embodiment 4 is an alloy of pentagonary or higher order, containing at least one metal of Cu, Ni, and Co, and Zn, a first rare earth element, and a second element, in which first rare earth elements are one or more element selected from the group consisting of Y, Dy, Er, Ho, Gd, Tb, and Tm, and in which second rare earth elements are one or more element selected from the group consisting of La, Ce, Pr, Nd, Sm, Eu, Yb, and Lu.

The composition range of the magnesium alloy according to the Embodiment 4 is the one in which a, b, c, and d satisfy the following formulae (1) to (3), and preferably a, b, c, and d satisfy the following formulae (1') to (3'), (the total content of the above-described one metal is defined as a atom %, the total content of the above-described one or more of the first rare earth elements is defined as b atom %, the content of Zn is defined as c atom %, and the total content of the above-described one or more of the second rare earth elements is defined as d atom %), $$0.2 < a+c \leqq 15 \quad (1)$$

$$0.2 < b+d \leqq 15 \quad (2)$$

$$2/3a - 2/3 < b \quad (3)$$

$$0.2 < a+c \leqq 5 \quad (1')$$

$$0.2 < b+d \leqq 5 \quad (2')$$

$$2/3a - 2/3 < b. \quad (3')$$

More preferably a, b, c, and d satisfy the following formulae (1) to (4), and most preferably a, b, c, and d satisfy the following formulae (1') to (4'), $$0.2 < a+c \leqq 15 \quad (1)$$

$$0.2 < b+d \leqq 15 \quad (2)$$

$$2/3a - 2/3 < b \quad (3)$$

$$c/a \leqq 1/2 \quad (4)$$

$$0.2 < a+c \leqq 5 \quad (1')$$

$$0.2 < b+d \leqq 5 \quad (2')$$

$$2/3a - 2/3 < b. \quad (3')$$

$$c/a \leqq 1/2. \quad (4')$$

The reason of the above is that, if the total content of the first rare earth elements and the second rare earth elements exceeds 15 atom %, specifically the toughness (or the ductility) tends to decrease. The reason for adding the second rare earth elements is that the second rare earth elements have an effect of refining crystal grains and have an effect of precipitating intermetallic compounds.

If the total content of the first rare earth elements and the second rare earth elements is less than 0.2 atom %, at least any of the strength and the toughness becomes insufficient. Therefore, the lower limit of the total content of the first rare earth elements and the second rare earth elements is specified to 0.2 atom %.

The reason for specifying the total content of the above-described one metal and zinc as the above range is similar to that of the Embodiment 2.

Embodiment 5

The magnesium alloy according to the Embodiment 5 of the present invention includes the one in which the composition of any of the Embodiments 1 to 4 contains Me. The Me is at least one element selected from the group consisting of Zr, Ti, Mn, Al, Ag, Sc, Sr, Ca, Si, Hf, Nb, B, C, Sn, Au, Ba, Ge, Bi, Ga, In, Ir, Li, Pd, Sb, V, Fe, Cr, and Mo. If the total content of Me is defined as e atom %, the e satisfies the following formula (5), preferably e and the a, b, and d further satisfy the following formula (6), $$0<e\leqq 2.5 \quad (5)$$

$$e/(a+b+c+d)\leqq 1/2. \quad (6)$$

The addition of Me can improve other properties while maintaining high strength and high toughness. For example, this provides an effect of corrosion resistance and crystal grain refinement.

The magnesium alloy according to each of above Embodiments 1 to 5 can also be applied to pluralities of chip-shaped casts each having several millimeters square or less prepared by cutting the cast.

Embodiment 6

The method for manufacturing the magnesium alloy according to the Embodiment 6 of the present invention is described below.

A magnesium alloy having the composition of any of the Embodiments 1 to 5 is melted to cast, thus preparing a magnesium alloy cast. The cooling speed of casting is within the range of 0.05K/sec to 1000 ($10^3$) K/sec, preferably 0.5K/sec to 1000 ($10^3$) K/sec. As the magnesium alloy cast, the one cut to a specific shape from an ingot is used.

Further, the magnesium alloy cast may be heat-treated. The condition of the heat treatment is preferably at temperatures ranging from 200° C. to 550° C. with treatment time ranging from 1 minute to 3600 minutes (or 60 hours).

The magnesium alloy cast has a crystal structure of long-period stacking ordered structure phase. The magnesium alloy cast has an α-Mg phase, which has a lamellar structure. In addition, the long-period stacking ordered structure phase kinks. The word "kink" referred to herein signifies that an intensely worked long-period stacking ordered structure phase has no specific directional relation, induces bending within the phase, and refines the long-period structure phase.

In some instances, the magnesium alloy contains other compound phases, in addition to the long-period stacking ordered structure phase and the α-Mg phase.

Next, plastic-working is carried out to the magnesium alloy cast. The method of plastic-working includes extrusion, ECAE (equal-channel-angular-extrusion) working method, rolling, drawing and forging, repeated working of above methods, and FSW working. The plastic-working preferably gives an amount of equivalent strain per at least one cycle within the range of more than zero to not more than 5. When the stress component in a multiaxial stress state is converted into a corresponding uniaxial stress, the converted stress is called the "equivalent stress". The term "amount of equivalent strain" signifies the amount of strain under the equivalent stress.

When the plastic-working is carried out by extrusion, it is preferable to select the extrusion temperature ranging from 200° C. to 500° C., and to select the reduction in area by extrusion of 5% or more.

The ECAE working method is one in which the sample longitudinal direction is rotated by 90° at every pass in order to introduce strain uniformly into the sample. Specifically, the method is to forcefully insert the magnesium alloy cast as the forming material into the molding hole of the molding die formed in a cross-sectional L shape, and a stress is applied to the magnesium alloy cast at a portion of 90° bend of the L-shaped molding hole, thus obtaining a molded article having excellent strength and toughness. The number of passes of ECAE is preferably within the range of 1 to 8, and more preferably 3 to 5. The temperature of ECAE working is preferably within the range of 200° C. to 500° C.

When the plastic-working is carried out by rolling, it is preferable to select the rolling temperature within the range of 200° C. to 500° C., and to select the reduction in thickness of 5% or more.

When the plastic-working is carried out by drawing, it is preferable to select the drawing temperature within the range of 200° C. to 500° C., and to select the reduction in area in the drawing of 5% or more.

When the plastic-working is carried out by forging, it is preferable to select the forging temperature within the range of 200° C. to 500° C., and to select the working rate of the forging of 5% or more.

The plastic work product prepared by carrying out plastic-working of the magnesium alloy cast, as described above, has a crystal structure of long-period stacking ordered structure phase at normal temperature. The plastic work product has an α-Mg phase, which has a lamellar structure. In addition, the long-period stacking ordered structure phase kinks. At least a part of the long-period stacking ordered structure phase is curved or bent. In some instances, the plastic work product contains other compound phases, in addition to the long-period stacking ordered structure phase and the α-Mg phase. For example, the plastic work product may contain at least one precipitate selected from the precipitate groups of: a compound of Mg with rare earth element; a compound of Mg with the above-described one metal; a compound of the above-described one metal with rare earth element; and a compound of Mg, the above-described one metal, and rare earth element. The plastic work product contains hcp-Mg. The plastic work product after treated by the plastic-working increases both the Vickers hardness and the yield strength compared with those of the cast before being subjected to plastic-working.

The plastic work product prepared by carrying out plastic-working of the magnesium alloy cast may be subjected to heat treatment. A preferable condition of the heat treatment is a temperature ranging from 200° C. to 500° C., and a heat-treatment time ranging from 1 minute to 3600 minutes (or 60 hours). The heat-treated plastic work product increases both the Vickers hardness and the yield strength compared with those of the plastic work product before being subjected to heat treatment. Similar to the case before conducting heat treatment, the heat-treated plastic work product has a crystal structure of long-period stacking ordered structure phase at normal temperature, and has an α-Mg phase, which has a lamellar structure. In addition, the long-period stacking ordered structure phase kinks. At least a part of the long-period stacking ordered structure phase is curved or bent. The plastic work product may contain at least one precipitate selected from the precipitate groups of: a compound of Mg with rare earth element; a compound of Mg with the above-described one metal; a compound of the above-described one metal with rare earth element; and a compound of Mg, the above-described one metal, and rare earth element. The plastic work product contains hcp-Mg.

According to the Embodiments 1 to 6, for expanded applications of magnesium alloys, such as applications as alloys for high-tech fields requiring high performance of both the strength and the toughness, there can be provided a high-strength and high-toughness magnesium alloy giving practical application level of both the strength and the toughness, and can be provided a method for manufacturing thereof.

When the magnesium alloy which is prepared by adding Zr by more than 0 atom % and not more than 2.5 atom % to the composition of any of the Embodiments 1 to 4 is melted and cast, the obtained magnesium alloy cast suppresses the precipitation of chemical compound, enhances the formation of long-period stacking ordered structure phase, and refines the crystal structure. Consequently, the magnesium alloy cast allows easy plastic-working such as extrusion, and the plastic work product after being treated by plastic-working has a large amount of long-period stacking ordered structure phase and of refined crystal structure compared with the amount thereof in the plastic work product of a magnesium alloy without the addition of Zr. With that large amount of long-period stacking ordered structure phase, both the strength and the toughness can be increased.

The long-period stacking ordered structure phase has a concentration modulation. The term "concentration modulation" means periodical variations in the solute element concentration at every atom layer.

Embodiment 7

The method for manufacturing the magnesium alloy according to the Embodiment 7 of the present invention is described below.

Similar to the method of the Embodiment 6, the magnesium alloy having the composition of any of the Embodiments 1 to 5 is melted to cast, thus preparing a magnesium alloy cast. Then, the magnesium alloy cast may be subjected to homogenized heat treatment.

Afterwards, pluralities of chip-shaped casts each having several millimeters square or less are prepared by cutting the magnesium alloy cast.

The chip-shaped casts may then be preformed by means of compression or plastic-working, and be heat-treated. The condition of the heat treatment is preferably at a temperature ranging from 200° C. to 550° C. for a treatment time ranging from 1 minute to 3600 minutes (or 60 hours).

The chip-shaped casts are commonly used as a raw material of thixotropic molding, for example.

A mixture of chip-shaped casts and ceramic particles may be preformed by means of compression or plastic-working, followed by heat treatment. The chip-shaped casts may be subjected to additional intense-strain working before applying performing.

Then, the chip-shaped casts are subjected to plastic-working. Varieties of plastic-working methods are applicable as in the case of the Embodiment 6.

Similar to the Embodiment 6, the plastic work product treated by plastic-working has a crystal structure of long-period stacking ordered structure at normal temperature. At least a part of the long-period stacking ordered structure phase is curved or bent. The plastic work product after treated by the plastic-working increases in both the Vickers hardness and the yield strength compared with those of the cast before the treatment of plastic-working.

The plastic work product after carrying out the plastic-working of the chip-shaped casts may be subjected to heat treatment. The condition of the heat treatment is preferably at a temperature ranging from 200° C. to 550° C. for a treatment time ranging from 1 minute to 3600 minutes (or 60 hours). The plastic work product after treated by the plastic-working increases in both the Vickers hardness and the yield strength compared with those of the plastic work product before the treatment of plastic-working. The plastic work product after the heat treatment has a crystal structure of long-period stacking ordered structure at normal temperature, similar to the case of the plastic work product before the heat treatment. At least a part of the long-period stacking ordered structure phase is curved or bent.

According to the Embodiment 7, since the cutting of casts to prepare the chip-shaped casts refines the structure, it is possible to manufacture a plastic work product or the like having higher strength, higher ductility, and higher toughness than those of the Embodiment 6. In addition, the magnesium alloy according to the Embodiment 7 can attain the characteristics of high strength and high toughness even when Zinc and rare earth element are at lower concentration than those of magnesium alloy in the Embodiment 6.

According to the Embodiment 7, for expanded applications of magnesium alloys, such as applications as alloys for high-tech fields requiring high performance of both the strength and the toughness, for example, there can be provided a high-strength and high-toughness magnesium alloy giving practical level of both the strength and the toughness, and can be provided a method for manufacturing thereof.

The long-period stacking ordered structure phase has a concentration modulation. The term "concentration modulation" means periodical variations in the solute element concentration in every atom layer.

Embodiment 8

The method for manufacturing the magnesium alloy according to the Embodiment 8 of the present invention is described below.

Figure 5:
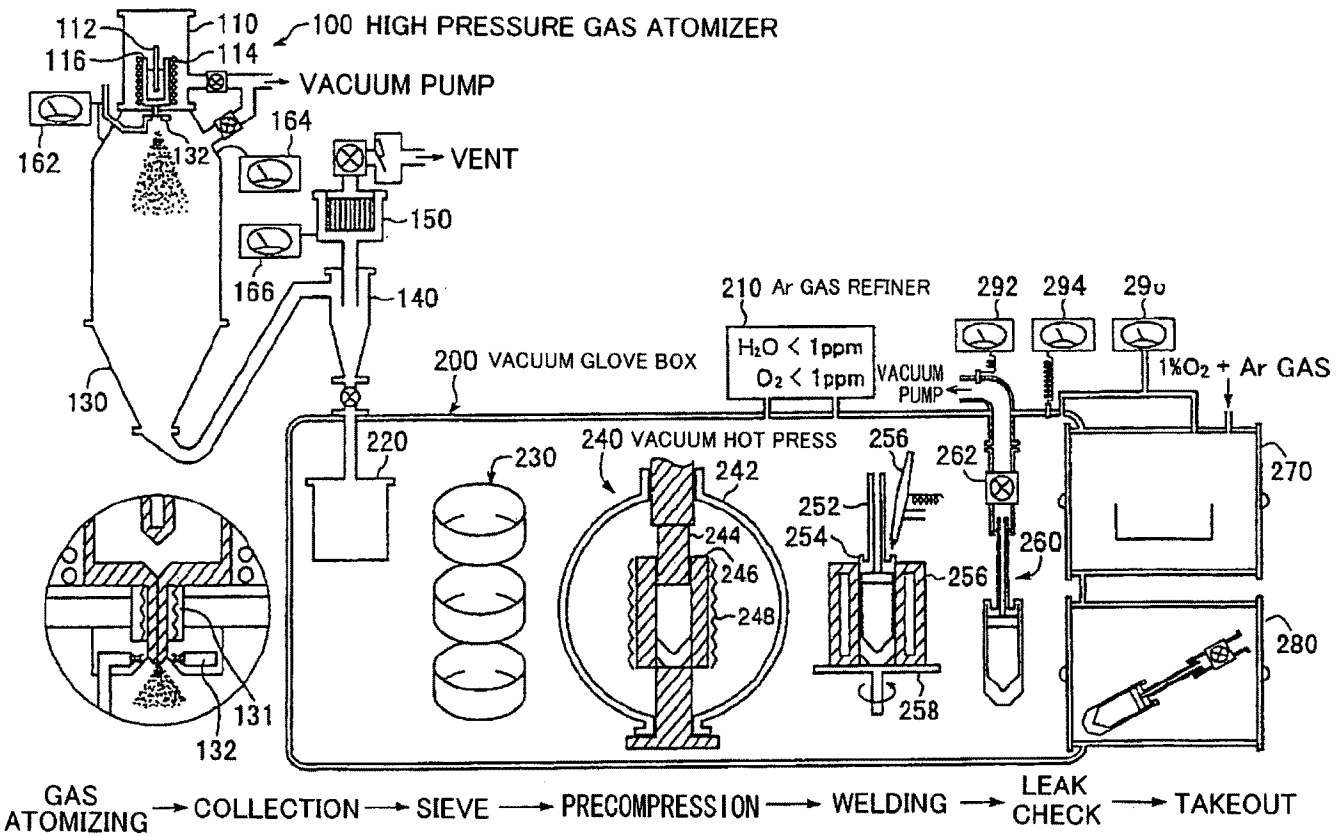
FIG. 5 illustrates the system preparing rapidly coagulated powder by the gas-atomizing method, and manufacturing an extrusion billet.
Figure 6:
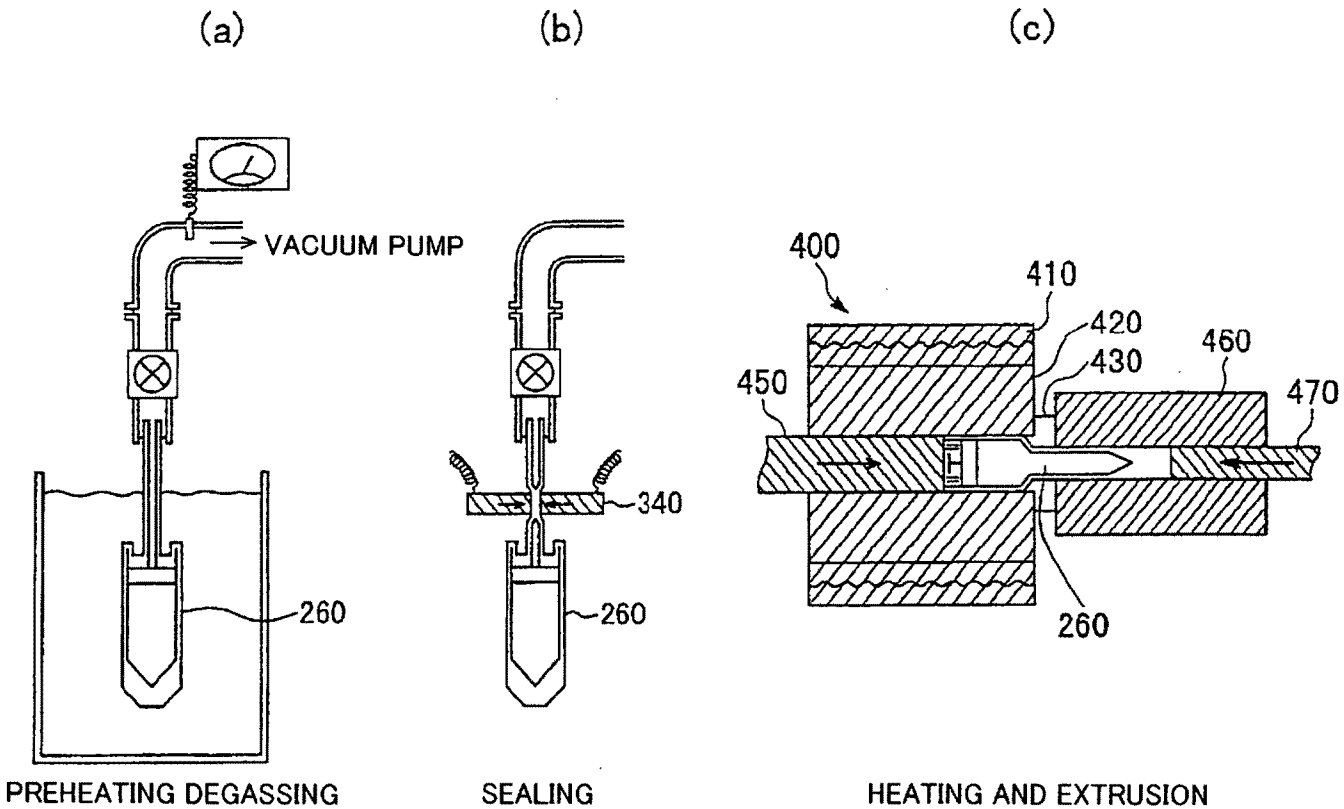
FIG. 6 illustrates the process of heating and pressing, thus solidifying and forming the billet.

Preparation of Rapidly Coagulated Powder and the solidification forming thereof use a closed P/M processing system. The system applied to preparing thereof is illustrated in FIG. 5 and FIG. 6. FIG. 5 illustrates the process of preparing rapidly coagulated powder using the gas atomize method, and of forming a billet from thus prepared rapidly coagulated powder by extrusion forming. FIG. 6 illustrates the process up to the extrusion forming of the prepared billet. The preparation of rapidly coagulated powder and the solidification forming thereof are described below in detail referring to FIG. 5 and FIG. 6.

Referring to FIG. 5, the powder of magnesium alloy having a target component ratio is prepared using a high pressure gas atomizer 100. That is, the alloy having the target components ratio is melted in a crucible 116 in a melting chamber 110 using an induction coil 114. The material of the alloy is the magnesium alloy having the composition of any of Embodiments 1 to 5.

The melted alloy is ejected by lifting a stopper 112, to which a high pressure inert gas (such as helium gas and argon gas) is blown to spray thereof through a nozzle 132, thus preparing the alloy powder. The cooling speed in the preparation step is within the range of 1000 ($10^3$) K/sec to 10000000 ($10^7$) K/sec, preferably 10000 ($10^4$) K/sec to 10000000 ($10^7$) K/sec. The nozzle and other parts are heated by a heater 131. In addition, an atomizing chamber 130 is monitored by an oxygen analyzer 162 and a vacuum gauge 164.

The prepared magnesium alloy powder has a crystal structure of long-period stacking ordered structure phase. The powder has an α-Mg phase, which the α-Mg phase has a lamellar structure. Further, the long-period stacking ordered structure phase kinks. In some instances, the powder contains other compound phases, in addition to the long-period stacking ordered structure phase and the α-Mg phase.

The prepared alloy powder is collected in a hopper 220 in a vacuum glove box 200 via a cyclone classifier 140. Succeeding treatments are given in the vacuum glove box 200. Then, the powder passes through a series of sieves 230, which stepwise refine the mesh opening, in the vacuum glove box 200 to obtain powder having a target fineness. According to the present invention, 32 μm or smaller size of powder was obtained. Instead of the powder, sheet or thin wire can also be prepared.

For forming a billet from the alloy powder, firstly the pre-compression is given to the powder using a vacuum hot press 240. The vacuum hot press applied was the one which can press 30 tons.

The alloy powder is packed in a copper can 254 using the hot press 240, and a cap 252 is applied onto the can. The can 254 with the cap 252 are welded together by a welding machine 256 while rotating them on a rotary disk 258, thus forming a billet 260. For leakage check of the billet 260, the billet 260 is connected to a vacuum pump via a valve 262, thus checking the leakage of the billet 260. If no leakage occurred, the valve 262 is closed, and the alloy billet 260 equipped with the valve 262, together with the vessel, is taken out from an entrance box 280 of the vacuum glove box 200.

As illustrated in FIG. 6, the billet 260 taken out is put in a heating furnace, which is connected to a vacuum pump for degassing while preheating the billet 260, (refer to FIG. 6(*a*)). Then, the cap of the billet 260 is squeezed, and the cap is spot-welded by a spot-welding machine 340, thus shutting off the connection between the billet 260 and external environment, (refer to FIG. 6(*b*)). After that, the alloy billet 260 together with the vessel is placed in an extrusion press 400 to form into the final shape, (refer to FIG. 6(*c*)). The extrusion press has a performance of 100 ton of the main press (at main stem 450 side) and 20 ton of the back press (at back stem 470 side). By heating the container 420 using a heater 410, the extrusion temperature can be adjusted.

As described above, the rapidly coagulated powder according to the Embodiment 8 was prepared by the high pressure He gas atomizing method. Thus prepared powder having particle size of 32 μm or less was packed in a copper can, which was vacuum-sealed to form the billet. The solidification forming was conducted by extrusion forming under the condition of extrusion temperature within the range of 623K to 723K, and extrusion ratio of 10:1. The extrusion forming applied pressure and shear to the powder, thus attaining densification and bonding between powder particles. The forming by rolling method or forging method also generates shear.

The magnesium alloy obtained by the above-described solidification forming has a crystal structure of long-period stacking ordered structure phase. The powder has an α-Mg phase, which has a lamellar structure. In addition, the long-period stacking ordered structure phase kinks. In some instances, the powder contains other compound phases, in addition to the long-period stacking ordered structure phase and the α-Mg phase According to the Embodiment 8, there is provided a magnesium alloy having high strength and high toughness. The magnesium alloy has a fine crystal structure having average crystal grain size of 1 μm or less.

EXAMPLES

Examples of the present invention are described as follows.

Example 1

There were ingoted $Mg_{97}Co_1Y_2$ alloy, $Mg_{97}Ni_1Y_2$ alloy, and $Mg_{97}Cu_1Y_2$ alloy for the Example 1, and $Mg_{97}Fe_1Y_2$ alloy for the Comparative Example 1 through high frequency induction melting in an Ar gas atmosphere. From each of the ingots, an extrusion billet, cut to a shape of 29 mm in diameter and 65 mm in length, was prepared.

Then, the extrusion billet was extruded under the condition of extrusion ratio of 10, extrusion temperature of 623K, and extrusion speed of 2.5 mm/sec, after preheating it at 623K for 20 minutes.

(Observation of Structure of Ingot)

Figure 2:
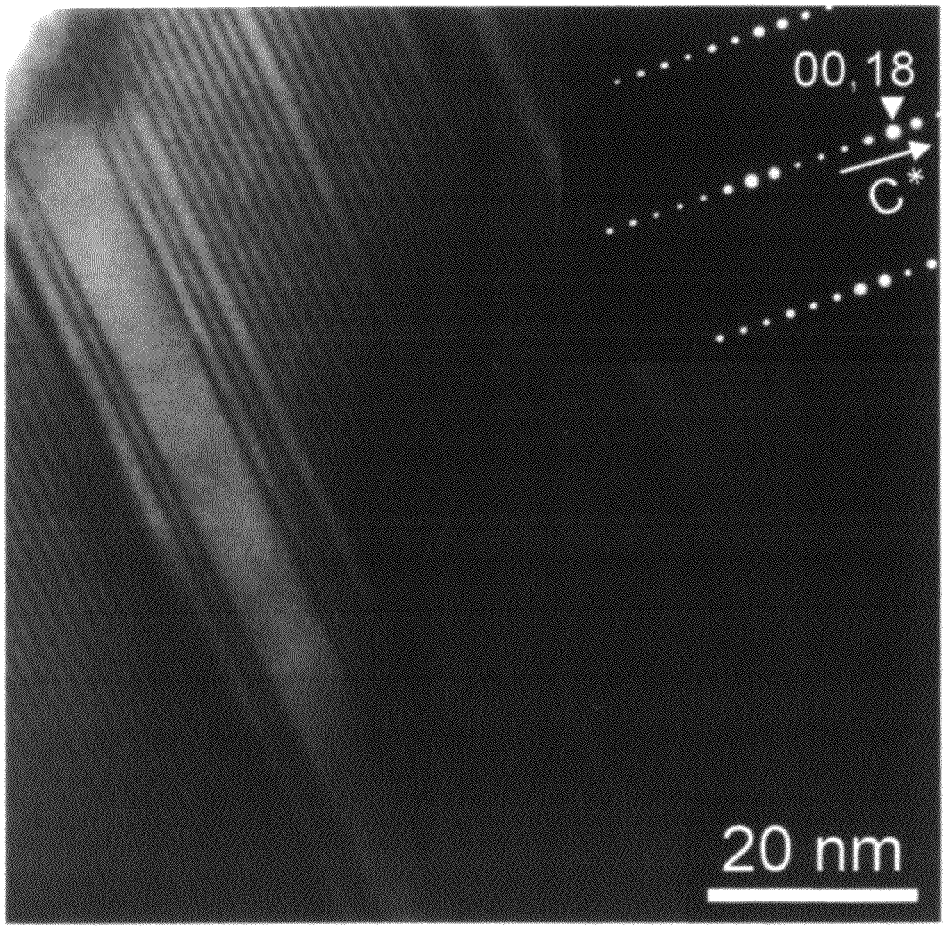
FIG. 2 shows a TEM micrograph of a long-period stacking ordered structure phase of an ingot of $Mg_{97}Cu_1Y_2$ alloy, and a diagram of electron beam diffraction on [1120].

The structure observation for the ingot was conducted by SEM and TEM. FIGS. 1(A) to 1(C) and FIG. 2 show the micrographs of these crystal structures. FIG. 1(A) shows an SEM micrograph of the ingot of $Mg_{97}CO_1Y_2$ alloy, FIG. 1(B) shows an SEM micrograph of the ingot of $Mg_{97}Ni_1Y_2$ alloy, and FIG. 1(C) shows an SEM micrograph of the ingot of $Mg_{97}Cu_1Y_2$ alloy. FIG. 2 shows a TEM micrograph of the long-period stacking ordered structure phase of the ingot of $Mg_{97}Cu_1Y_2$ alloy, and the electron beam diffraction image on [1120].

The ingot of $Mg_{97}Fe_1Y_2$ alloy as the Comparative Example 1 did not show long-period stacking ordered structure phase. To the contrary, as shown in FIG. 1(A), the ingot of $Mg_{97}CO_1Y_2$ alloy as the Example 1 showed a lamellar structure indicating the formation of long-period stacking ordered structure phase other than the compound phase. Further, as shown in FIGS. 1(B) and 1(C), each ingot of $Mg_{97}Ni_1Y_2$ alloy and $Mg_{97}Cu_1Y_2$ alloy showed a significant lamellar structure indicating the formation of long-period stacking ordered structure phase, and specifically the $Mg_{97}Cu_1Y_2$ alloy showed a long-period stacking ordered structure phase at the highest volume fraction.

According to the electron beam diffraction image given in FIG. 2, it was confirmed that the long-period stacking ordered structure phase observed in the $Mg_{97}Cu_1Y_2$ alloy is the same 18R type as that of the Mg—Zn—Y series alloys.

(Vickers Hardness Test)

The Vickers hardness of the extruded material of the $Mg_{97}Cu_1Y_2$ alloy was 87HV0.5. The Vickers hardness of the extruded material of the $Mg_{97}Ni_1Y_2$ alloy was 90.1HV0.5. The Vickers hardness of the extruded material of the $Mg_{97}CO_1Y_2$ alloy was 81HV0.5. The Vickers hardness of the extruded material of the $Mg_{97}Fe_1Y_2$ alloy was 77.6HV0.5.

Figure 3:
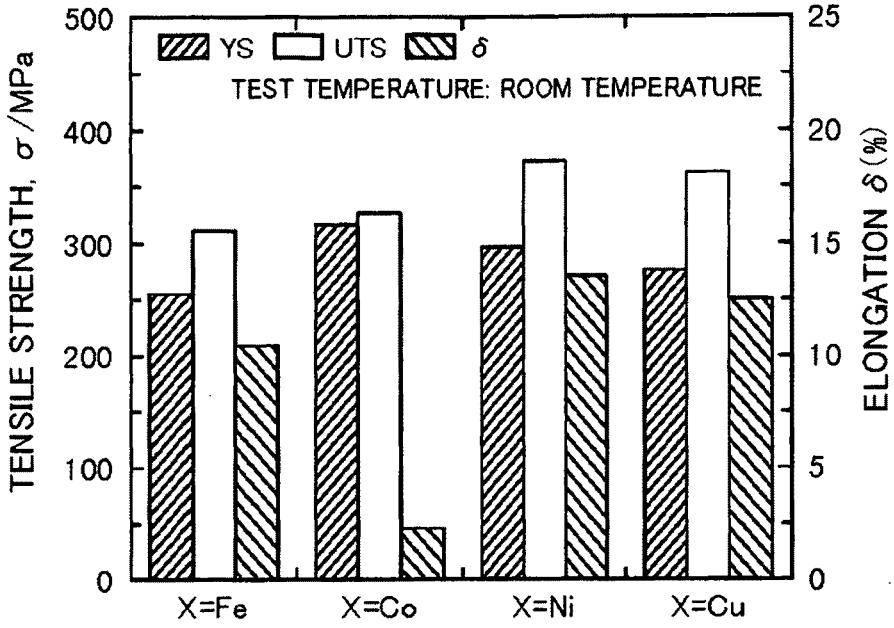
FIG. 3 shows a result of tensile test for the extruded materials of $Mg_{97}X_1Y_2$ (X=Fe, Co, Ni, or Cu) alloy at room temperature, which are the materials of Example 1 and Comparative Example 1.

FIG. 3 shows the result of tensile test for the extruded materials of $Mg_{97}X_1Y_2$ (X=Fe, Co, Ni, or Cu) alloys at room temperature, which materials are for the Example 1 and the Comparative Example. Table 1 shows the result of tensile test for the extruded materials of the Example 1 at room temperature, (YS: yield strength, UTS: tensile strength, and elongation (%)), and hardness Hv.

TABLE 1

Result of Mg—X—Y tensile test at room temperature

| Alloy component | Extrusion temperature | Hv | YS | UTS | Elongation | |
|---|---|---|---|---|---|---|
| Mg97Fe1Y2 | 623 K | 77.6 | 255 | 308 | 10.5 | Comparative Example |
| Mg97Co1Y2 | 623 K | 81.3 | 315 | 326 | 2.3 | Example |
| Mg97Ni1Y2 | 623 K | 90.1 | 293 | 373 | 13.6 | Example |
| Mg97Cu1Y2 | 623 K | 87.7 | 276 | 363 | 12.5 | Example |
| Mg97Cu1Y2 | 598 K | | 297 | 377 | 8.1 | Example |

As shown in FIG. 3 and Table 1, the $Mg_{97}Fe_1Y_2$ alloy not forming long-period stacking ordered structure phase had only a relatively low strength. On the other hand, the $Mg_{97}CO_1Y_2$ alloy, the $Mg_{97}Ni_1Y_2$ alloy, and the $Mg_{97}Cu_1Y_2$ alloy, forming a long-period stacking ordered structure phase, had high strength, giving the yield strength (YS) of 315 MPa, 293 MPa, and 276 MPa, respectively. The $Mg_{97}Ni_1Y_2$ alloy and the $Mg_{97}Cu_1Y_2$ alloy having large amount of formed long-period stacking ordered structure phase, exhibited good ductility of 12% or more. However, the $mg_{97}Co_1Y_2$ alloy exhibited only relatively low ductility caused by the presence of chemical compounds.

Figure 4:
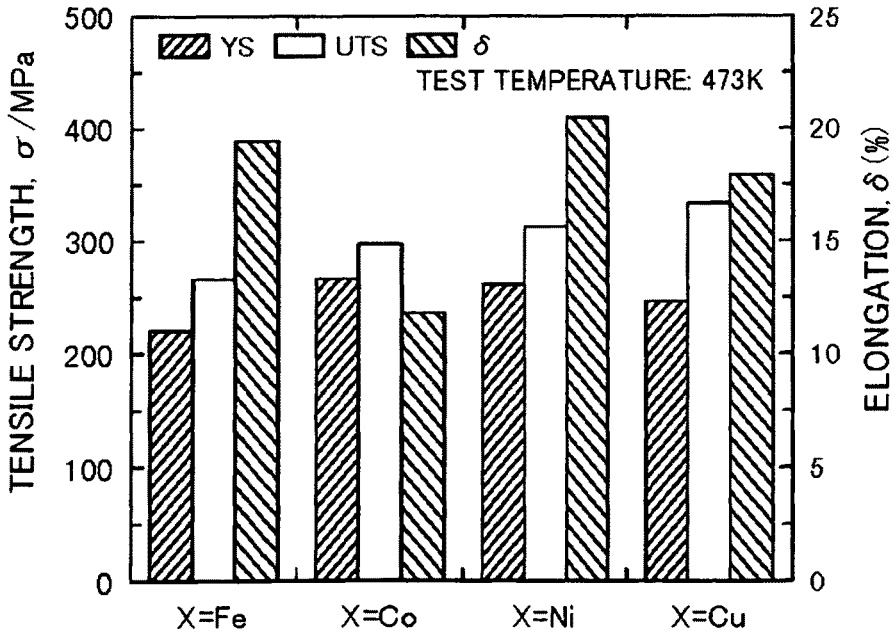
FIG. 4 shows a result of tensile test for the extruded materials of $Mg_{97}X_1Y_2$ (X=Fe, Co, Ni, or Cu) alloy at 473K, which are the materials of Example 1 and Comparative Examples.

FIG. 4 shows the result of tensile test for the extruded materials of $Mg_{97}X_1Y_2$ (X=Fe, Co, Ni, or Cu) alloys at 473K, which are for the Example 1 and the Comparative Example. Table 2 shows the result of tensile test at 473K for the extruded materials of the Example 1, (YS: yield strength, UTS: tensile strength, and elongation (%)).

TABLE 2

Result of Mg—X—Y high temperature tensile test
Test temperature: 473 K

| Alloy component | Extrusion temperature | YS | UTS | Elongation | |
|---|---|---|---|---|---|
| Mg97Fe1Y2 | 623 K | 217 | 266 | 19.4 | Comparative Example |
| Mg97Co1Y2 | 623 K | 269 | 299 | 11.8 | Example |
| Mg97Ni1Y2 | 623 K | 262 | 312 | 20.7 | Example |
| Mg97Cu1Y2 | 623 K | 245 | 334 | 18 | Example |
| Mg97Cu1Y2 | 598 K | 273 | 344 | 16.3 | Example |

As shown in Table 2, though the $Mg_{97}CO_1Y_2$ alloy had large high-temperature strength, giving yield strength of 269 MPa, the high-temperature strength was somewhat low compared with the room-temperature strength. On the other hand, the $Mg_{97}Ni_1Y_2$ alloy and the $Mg_{97}Cu_1Y_2$ alloy gave relatively small difference between the room-temperature strength and the high-temperature strength, and thus these alloys maintained high strength even in high-temperature zone. Consequently, it was confirmed that the long-period stacking ordered structure phase significantly contributes to the improvement in the mechanical properties, or significantly contributes to the high strength and high ductility, in high-temperature zone.

Example 2

There were ingoted $Mg_{85}Cu_6Y_9$ alloy, $Mg_{85}Ni_6Y_9$ alloy, and $Mg_{85}CO_6Y_9$ alloy, respectively, for the Example 2 through high frequency induction melting in an Ar gas atmosphere.

Then, the ingot was treated by hot-rolling. The hot-rolling was carried out at the condition of rolling rate of 50 to 70% and rolling temperature of 250° C. to 400° C., after preheating at 200° C. for 30 minutes.

(Observation of Structure of Ingot)

Figure 7:
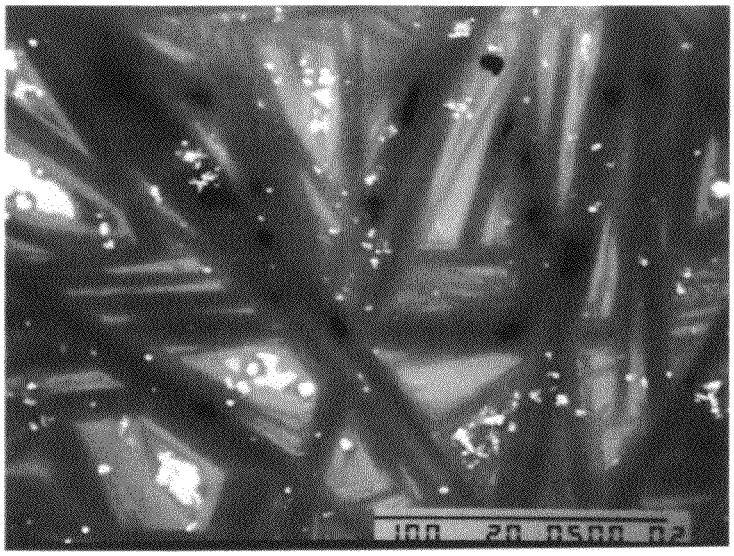
FIG. 7 is an SEM micrograph of an ingot of $Mg_{85}Cu_6Y_9$ alloy in Example 2.
Figure 8:
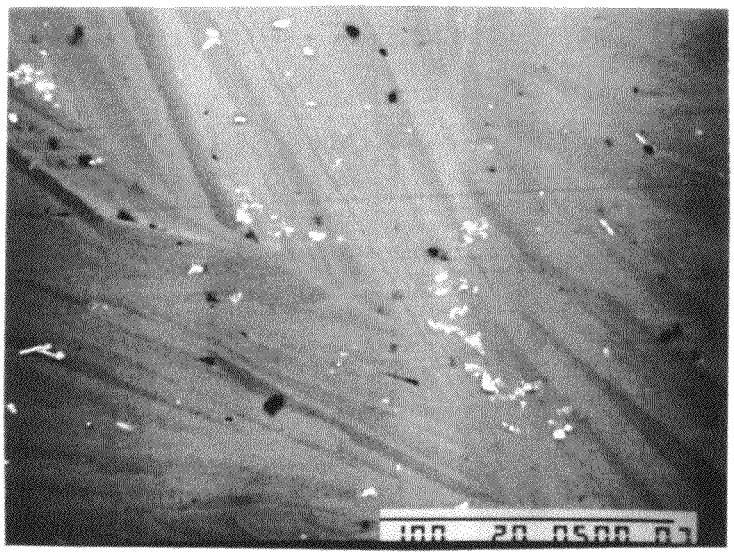
FIG. 8 is an SEM micrograph of an ingot of $Mg_{85}Ni_6Y_9$ alloy in Example 2.
Figure 9:
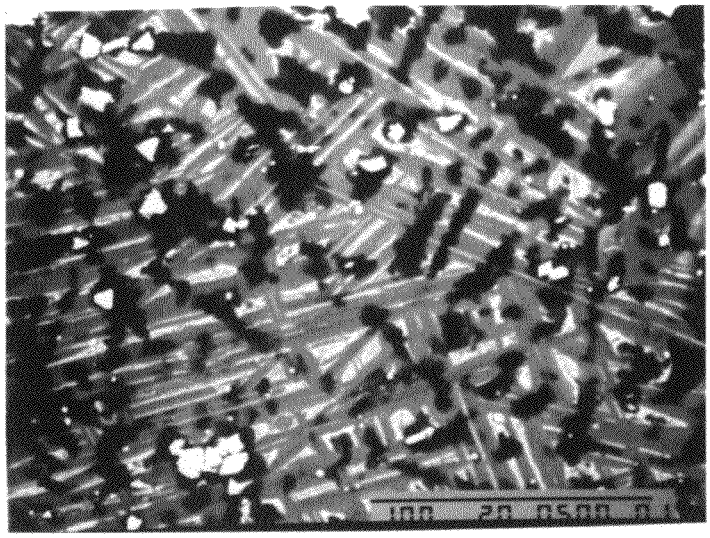
FIG. 9 is an SEM micrograph of an ingot of $Mg_{85}CO_6Y_9$ alloy in Example 2.
Figure 10:
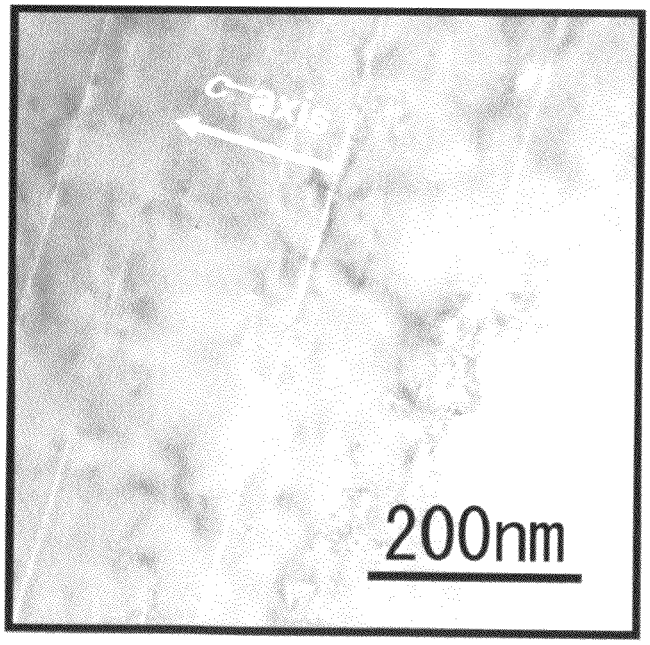
FIG. 10 shows a TEM micrograph of a long-period stacking ordered structure phase of an ingot of $Mg_{85}Cu_6Y_9$ alloy in Example 2.
Figure 11:
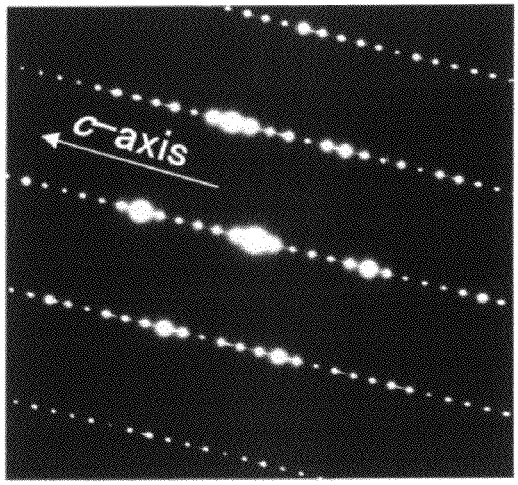
FIG. 11 shows a diffraction pattern of a long-period stacking ordered structure phase of 18R type formed in an ingot of $Mg_{85}Cu_6Y_9$ alloy in Example 2.
Figure 12:
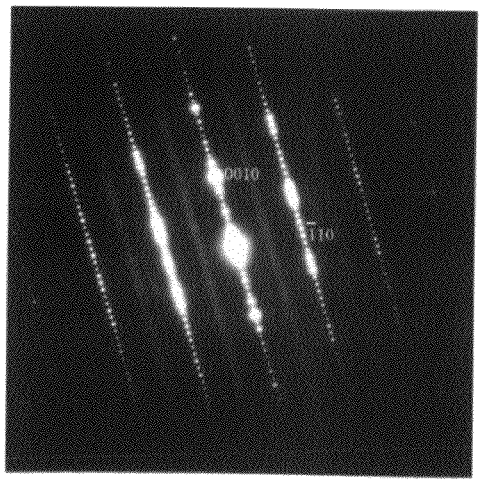
FIG. 12 shows a diffraction pattern of a long-period stacking ordered structure phase of 10H type formed in an ingot of $Mg_{85}Cu_6Y_9$ alloy in Example 2.

The observation of structure of ingot was given by SEM and TEM. FIGS. 7 to 12 show the photographs of crystal structures of the respective ingots. FIG. 7 is an SEM micrograph of the ingot of $Mg_{85}Cu_6Y_9$ alloy. FIG. 8 is an SEM micrograph of the ingot of $Mg_{85}Ni_6Y_9$ alloy. FIG. 9 is an SEM micrograph of the ingot of $Mg_{85}CO_6Y_9$ alloy. FIG. 10 is a TEM micrograph of a long-period stacking ordered structure phase of the ingot of $Mg_{85}Cu_6Y_9$ alloy. FIG. 11 shows the diffraction pattern of the long-period stacking ordered structure phase of 18R type formed in the ingot of $Mg_{85}Cu_6Y_9$ alloy. FIG. 12 shows the diffraction pattern of the long-period stacking ordered structure phase of 10H type formed in the ingot of $Mg_{85}Cu_6Y_9$ alloy.

As shown in FIGS. 7 to 9, each ingot of $Mg_{85}Cu_6Y_9$ alloy, $Mg_{85}Ni_6Y_9$ alloy, and $Mg_{85}CO_6Y_9$ alloy in the Example 2 showed a plate-shaped structure having a size of about 10 to 30 μm. The sheet-shaped structure was 10H type or 18R type long-period stacking ordered structure phase. The scale bar given in FIGS. 7 to 9 indicates 100 μm.

On the TEM micrographs and the electron beam diffraction image given in FIG. 10 and FIG. 11, there was identified the 18R type long-period stacking ordered structure phase in the $Mg_{85}Cu_6Y_9$ alloy. On the electron beam diffraction image given in FIG. 12, there was identified the 10H type long-period stacking ordered structure phase in the $Mg_{85}Cu_6Y_9$ alloy.

In addition, 18R type and 10H type long-period stacking ordered structure phases were identified in the respective ingots of $Mg_{85}Ni_6Y_9$ alloy and $Mg_{85}CO_6Y_9$ alloy.

(Vickers Hardness Test)

Vickers hardness test was performed for both the ingots and the hot-rolled materials.

The Vickers hardnesses of the ingot and the hot-rolled material of $Mg_{85}Cu_6Y_9$ alloy were 108HV0.5 and 150HV0.5, respectively. The Vickers hardnesses of the ingot and the hot-rolled material of $Mg_{85}Ni_6Y_9$ alloy were 110HV0.5 and 147HV0.5, respectively. The Vickers hardnesses of the ingot and the hot-rolled material of $Mg_{85}CO_6Y_9$ alloy were 105HV0.5 and 138HV0.5, respectively.

As described above, since the ingots and the hot-rolled materials of the Example 2 have high hardnesses, the magnesium alloys in the Example 2 also presumably have high strength.

Example 3

<Sample Preparation>

(Preparation of Ingot)

An Mg alloy was melted in an iron crucible using an electric furnace while introducing $CO_2$ gas into the crucible. The melted Mg alloy was poured in an iron mold to prepare the ingot sample. In detail, the respective materials were weighed. After weighing, the Mg was first poured in the iron crucible to melt. After melting the Mg, elements were added, and the mixture was heated up to 1123K, and held the temperature for 10 minutes. Afterwards, the mixture was agitated by an iron rod to tap into the mold.

(Preparation of Rapidly Cooled Material)

An Mg alloy was melted in an iron crucible using an electric furnace while introducing $CO_2$ gas into the crucible. The melted Mg alloy was poured in a copper mold to prepare the rapidly cooling sample. In detail, the respective ingots were placed in the respective crucibles. The $Mg_{97}X_1Y_2$ (X=Cu or Ni) alloy was heated up to 1123K, the $Mg_{94}X_2Y_4$ (X=Cu or Ni) alloy was heated up to 1098K, and the $Mg_{100-A-B}X_AY_B$ (X=Cu or Ni, A=3 to 3.5, and B=6 to 7)

alloy was heated up to 1073K, and was kept at the temperature for 10 minutes. Afterwards, the alloy was tapped into a water-cooling type copper mold to rapidly cool the alloy.

(Preparation of Rolled Material)

The rapidly cooled $Mg_{91}X_3Y_6$ (X=Cu or Ni) alloy was treated by hot-rolling at 623K to 70% of reduction in area to prepare the rolled sample. The rolling was conducted by rotating the mill-roll at a speed of 8.6 rpm while heating the mill-roll by a gas burner, and the rapidly cooled $Mg_{91}X_3Y_6$ (X=Cu or Ni) alloy kept at 623K in an electric furnace was rolled.

(Preparation of Tensile Test Piece)

Sheet-shaped test piece of 14B grade specified by JIS was prepared using a discharge wire working machine (FA20, manufactured by Mitsubishi Electric Corporation). The dimensions of the prepared tensile test piece were 9.45 mm of distance between gauge marks, 12.8 mm of length of parallel section, and 15.0 mm of shoulder radius. After working, the test piece was polished by a water-proof abrasive paper and by a buff-polisher.

(Preparation of Heat-Treated Material)

The prepared tensile test piece of rolled $Mg_{91}X_3Y_6$ (X=Cu or Ni) alloy was treated by strain-removing annealing. The rolled material was held at 673K in air for 6 hours in an electric furnace, and then was immediately immersed in, water to rapidly cool.

(Mechanical Characteristics of Rapidly Cooled $Mg_{100-A-B}Cu_AY_B$ (A=1 to 3.5, B=2 to 7) Alloy)

The rapidly cooled $Mg_{100-A-B}Cu_AY_B$ (A=1 to 3.5, B=2 to 7) alloy was subjected to tensile test at room temperature. The rapidly cooled $Mg_{97}Cu_1Y_2$ alloy showed the proof stress (hereinafter referred to as $\sigma_{0.2}$) of 121 MPa, the tensile strength (hereinafter referred to as $\sigma_B$) of 215 MPa, and the elongation (hereinafter referred to as δ) of 14% at room temperature. The rapidly cooled $Mg_{94}Cu_2Y_4$ alloy showed $\sigma_{0.2}$ of 191 MPa, $\sigma_B$ of 257 MPa, and δ of 8%, which showed increased strength compared with that of the $Mg_{97}Cu_1Y_2$ alloy, though the elongation becomes smaller. Furthermore, the rapidly cooled $Mg_{91}Cu_3Y_6$ alloy showed $\sigma_{0.2}$ of 257 MPa, $\sigma_B$ of 312 MPa, and δ of 6%, and the rapidly cooled $Mg_{90.5}Cu_{3.25}Y_{6.25}$ alloy showed $\sigma_{0.2}$ of 277 MPa, $\sigma_B$ of 328 MPa, and δ of 5%, both of which showed a tendency to increase in the strength, though the elongation becomes smaller with an increase in the amount of added element. However, the rapidly cooled $Mg_{89.5}Cu_{3.5}Y_7$ alloy showed δ of 1%, and it was fractured in brittle mode in the elastic region so that the strength also decreased to $\sigma_B$ of 221 MPa. The above result showed that the increase in the amount of added elements of Cu and Y increases long-period phase, and increases the strength. However, the above result also showed that the increase in the amount of added element to the level of the $Mg_{89.5}Cu_{3.5}Y_7$ alloy generates brittle fracture. Consequently, it was found that the ductility can be increased by dispersing an adequate amount of Mg phase in the long-period phase to establish a multiple phase.

(Rolling Work and Mechanical Characteristics of $Mg_{91}Cu_3Y_6$ Alloy)

Since the tensile test of rapidly cooled materials showed that the $Mg_{91}Cu_3Y_6$ alloy has high strength and adequate ductility, giving yield strength of 257 MPa and elongation of 6%, the inventors of the present invention have conducted tensile test to the rapidly cooled $Mg_{91}Cu_3Y_6$ alloy, and to the rolled product thereof, and further to the heat-treated material thereof after rolling, in the temperature range of room temperature to 623K, and have investigated the mechanical characteristics after the rolling.

(Mechanical Characteristics of Rapidly Cooled $Mg_{91}Cu_3Y_6$ Alloy)

The rapidly cooled $Mg_{91}Cu_3Y_6$ alloy showed the proof stress (hereinafter referred to as $\sigma_{0.2}$) of 257 MPa, the tensile strength (hereinafter referred to as $\sigma_B$) of 312 MPa, and the elongation (hereinafter referred to as δ) of 6% at room temperature. At 525K, the rapidly cooled $Mg_{91}Cu_3Y_6$ alloy showed $\sigma_{0.2}$ of 203 MPa, $\sigma_B$ of 250 MPa, and δ of 7%. At 573K, the rapidly cooled $Mg_{91}Cu_3Y_6$ alloy showed $\sigma_{0.2}$ of 152 MPa, $\sigma_B$ of 192 MPa, and δ of 11%. At 598K, the rapidly cooled $Mg_{91}Cu_3Y_6$ alloy showed $\sigma_{0.2}$ of 109 MPa, $\sigma_B$ of 125 MPa, and δ of 34%. At 623K, the rapidly cooled $Mg_{91}Cu_3Y_6$ alloy showed $\sigma_{0.2}$ of 61 MPa, $\sigma_B$ of 74 MPa, and δ of 100%. The tendency showed that the strength decreases and the elongation increases with the increase in the temperature. In addition, even at a high temperature of 523K, the high yield strength of 150 MPa was maintained so that the rapidly cooled $Mg_{91}Cu_3Y_6$ alloy was found to be as an alloy having high strength even in high temperature range.

(Hardness of $Mg_{91}Cu_3Y_6$ Alloy)

The hardness of rolled $Mg_{91}Cu_3Y_6$ alloy was 119Hv0.5, showing the increase in the hardness compared with 100Hv0.5 of the rapidly cooled $Mg_{91}Cu_3Y_6$ alloy. Also for the heat-treated $Mg_{91}Cu_3Y_6$ alloy, the hardness test was conducted. Since the heat-treated $Mg_{91}Cu_3Y_6$ alloy showed the hardness of 108Hv0.5 and the decrease in the hardness by heat treatment, the strain of Mg and of long-period was presumably relaxed.

(Mechanical Characteristics of Heat-Treated $Mg_{91}Cu_3Y_6$ Alloy)

It is known that a material in as-rolled state accumulates strain therein, and that fracture occurs almost within the elastic region. Based on the phenomenon, stress-removing annealing was given to the rolled $Mg_{91}Cu_3Y_6$ alloy at 673K for 6 hours. Tensile test was given to the heat-treated $Mg_{91}Cu_3Y_6$ alloy to investigate the mechanical characteristics. The heat-treated $Mg_{91}Cu_3Y_6$ alloy showed the proof stress (hereinafter referred to as $\sigma_{0.2}$) of 412 MPa, the tensile strength (hereinafter referred to as $\sigma_B$) of 477 MPa, and the elongation (hereinafter referred to as δ) of 6% at room temperature. At 523K, the heat-treated $Mg_{91}Cu_3Y_6$ alloy showed $\sigma_{0.2}$ of 254 MPa, $\sigma_B$ of 284 MPa, and δ of 24%. At 573K, the heat-treated $Mg_{91}Cu_3Y_6$ alloy showed $\sigma_{0.2}$ of 199 MPa, $\sigma_B$ of 223 MPa, and δ of 46%. At 598K, the heat-treated $Mg_{91}Cu_3Y_6$ alloy showed $\sigma_{0.2}$ of 105 MPa, $\sigma_B$ of 134 MPa, and δ of 69%. At 623K, the heat-treated $Mg_{91}Cu_3Y_6$ alloy showed $\sigma_{0.2}$ of 66 MPa, $\sigma_B$ of 81 MPa, and did not fracture even at δ of 63%. Similar to the case of rapidly cooled material, the above phenomenon showed a tendency of decrease in the strength and increase in the elongation with increase in the temperature. For the heat-treated material, the yield strength $\sigma_{0.2}$ gave as high as 400 MPa or more at room temperature. In addition, in a high temperature range, the heat-treated material gave high strength and increased elongation compared with those of the rapidly cooled material. A presumable reason of the phenomenon is that the material-defects such as cast-defects (voids) in the sample, which supposedly existed in the rapidly cooled material, are collapsed by the rolling work. Particularly in view of strength, it is presumed that the bottom plane (0018) of the long-period phase formed a texture in parallel with the rolled sheet plane. In hexagonal system, if the direction of external force during deformation of the material is in parallel with or vertical to the bottom plane, the shearing force applied to the bottom plane becomes zero, which prevents the generation of sliding deformation, and increases the yield strength, though no plastic deformation occurs. Therefore, the $Mg_{91}Cu_3Y_6$ alloy further significantly increases the strength by applying hot-rolling, thus obtaining an Mg alloy having also adequate ductility.

(Rolling Work and Mechanical Characteristics of $Mg_{90.5}Cu_{3.25}Y_{6.25}$ Alloy)

Tensile test was conducted for a rolled $Mg_{91}Cu_3Y_6$ alloy. It was found that the $Mg_{91}Cu_3Y_6$ alloy has excellent characteristics, giving high yield strength of 400 MPa or more, and elongation of 6%, at room temperature. To create an alloy having further high strength, it is expected to apply rolling to the $Mg_{90.5}Cu_{3.25}Y_{6.25}$ alloy which has higher strength than $Mg_{91}Cu_3Y_{6.25}$ and has ductility to some degree, giving 4.6% elongation of 4.6%. Thus, the inventors of the present invention have prepared a rapidly cooled $Mg_{90.5}Cu_{3.25}Y_{6.25}$ alloy, to which the rolling was applied to form a sample. The sample was subjected to tensile test to investigate the mechanical characteristics.

(Mechanical Characteristics of Heat-Treated $Mg_{90.5}Cu_{3.25}Y_{6.25}$ alloy)

Concerning thus prepared heat-treated $Mg_{90.5}Cu_{3.25}Y_{6.25}$ alloy, tensile test was conducted in a temperature range of room temperature to 623K to determine the mechanical characteristics. Table 3 shows the result. At room temperature, the $Mg_{90.5}Cu_{3.25}Y_{6.25}$ alloy showed the proof stress (hereinafter referred to as $\sigma_{0.2}$) of 448 MPa, the tensile strength (hereinafter referred to as $\sigma_B$) of 512 MPa, and the elongation (hereinafter referred to as δ) of 6%. At 523K, the $Mg_{90.5}Cu_{3.25}Y_{6.25}$ alloy showed $\sigma_{0.2}$ of 342 MPa, $\sigma_B$ of 375 MPa, and δ of 25%. At 573K, the $Mg_{90.5}Cu_{3.25}Y_{6.25}$ alloy showed ° 0.2 of 228 MPa, $\sigma_B$ of 245 MPa, and δ of 44%. At 598K, the $Mg_{90.5}Cu_{3.25}Y_{6.25}$ alloy showed $\sigma_{0.2}$ of 177 MPa, $\sigma_B$ of 189 MPa, and δ of 47%. At 623K, the $Mg_{90.5}Cu_{3.25}Y_{6.25}$ alloy showed $\sigma_{0.2}$ of 54 MPa, $\sigma_B$ of 61 MPa, and δ of 143%. These values show higher strength and equivalent to or somewhat lower ductility than those of the heat-treated $Mg_{91}Cu_3Y_6$ alloy. This is attributed to the increase in the area percent of the long-period phase and the increase in the work rate through rolling.

In addition, it was observed that there is a decreasing tendency in the strength and an increasing tendency in the elongation with the increase in the temperature, similar to the case of heat-treated $Mg_{91}Cu_3Y_6$ alloy. Since in the heat-treated material, $\sigma_{0.2}$ indicates 448 MPa and $\sigma_B$ is higher than 500 MPa at room temperature, it can be said that the heat-treated $Mg_{90.5}Cu_{3.25}Y_{6.25}$ alloy is a material which has an adequate ductility while keeping very high strength exceeding that of the heat-treated $Mg_{91}Cu_3Y_6$ alloy.

Figure 13:
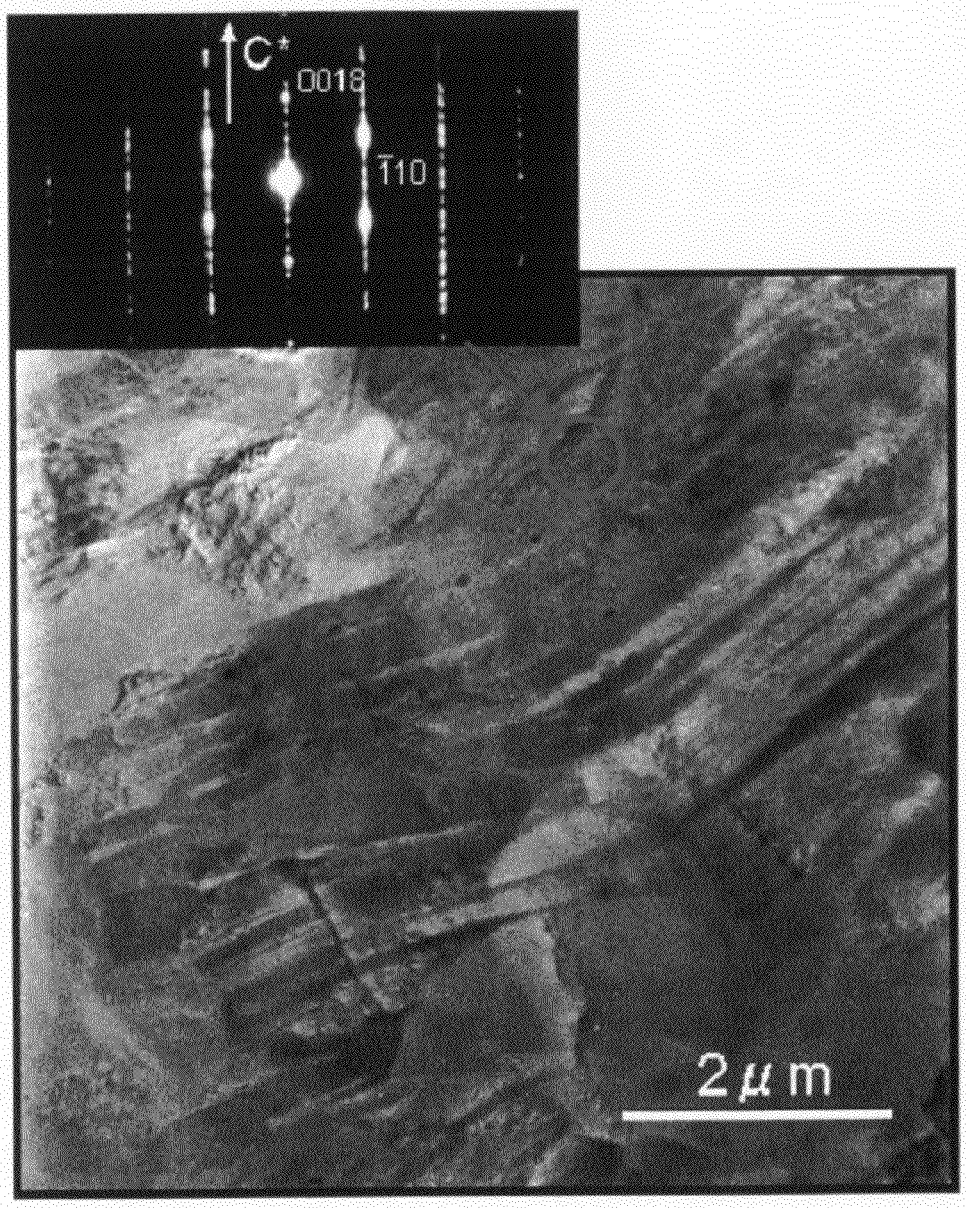
FIG. 13 shows a TEM micrograph and an electron beam diffraction pattern of a heat-treated $Mg_{91}Cu_3Y_6$ alloy in Example 3.

FIG. 13 shows a TEM micrograph and an electron beam diffraction pattern of the heat-treated $Mg_{91}Cu_3Y_6$ alloy. As seen in FIG. 13, the structure is in a two-phase state of Mg grains and long-period phase. It was found that a structural bend (curve) occurred at long intervals, which also presumably contributes to the increase in strength. Although the structure in FIG. 13 is for the heat-treated $Mg_{91}Cu_3Y_6$ alloy, it is considered that the same is true of the heat-treated $Mg_{90.5}Cu_{3.25}Y_{6.25}$ alloy.

TABLE 3

Mechanical characteristics of heat-treated rolled $Mg_{90.5}X_{3.25}Y_{6.25}$ (X = Cu, Zn, or Ni)

| Sample | Tensile temperature | Proof stress $\sigma_{0.2}$/MPa | Tensile strength $\sigma_B$/MPa | Elongation δ/% | Specific strength $\sigma_{0.2}/\rho/(2)$ | Specific gravity $\rho/Mg \cdot m^{-3}$ |
|---|---|---|---|---|---|---|
| Heat-treated rolled $Mg_{90.5}Cu_{3.25}Y_{6.25}$ alloy | Room temperature | 448 | 512 | 6 | 214 | 2.098 |
| | 523 K | 342 | 375 | 25 | 163 | |
| | 573 K | 228 | 245 | 44 | 109 | |
| | 598 K | 177 | 189 | 47 | 84 | |
| | 673 K | 54 | 61 | 143 | 26 | |
| Heat-treated rolled $Mg_{90.5}Zn_{3.25}Y_{6.25}$ alloy | Room temperature | 353 | 400 | 5 | 169 | 2.093 |
| | 523 K | 279 | 317 | 14 | 133 | |
| | 573 K | 150 | 170 | 23 | 72 | |
| | 598 K | 131 | 145 | 32 | 63 | |
| | 673 K | 80 | 88 | 57 | 38 | |
| Heat-treated rolled $Mg_{90.5}Ni_{3.25}Y_{6.25}$ alloy | Room temperature | 460 | 526 | 8 | 220 | 2.090 |
| | 523 K | 301 | 245 | 12 | 144 | |
| | 573 K | 224 | 236 | 25 | 107 | |
| | 598 K | 159 | 176 | 34 | 76 | |
| | 673 K | 114 | 126 | 43 | 55 | |

Table 3 shows the mechanical characteristics of the alloys prepared in the Example 3. At room temperature, the heat-treated $Mg_{90.5}Cu_{3.25}Y_{6.25}$ alloy and the heat-treated $Mg_{90.5}Ni_{3.25}Y_{6.25}$ alloy showed higher specific strength than that of A7075-T6 (A7075: Al-1.2% Cu-6% Zn-2% Mg-0.25% Cr-0.25% Mn, T6: state treated through artificial aging effect after solution treatment), giving very high specific strength, though the specific strength was slightly lower than that of Ti-6Al-4V. Further, the specific strength of the heat-treated $Mg_{90.5}Zn_{3.25}Y_{6.25}$ alloy exceeded that of the commercialized magnesium alloys. Regarding the specific strength at 523K, all the alloys of heat-treated $Mg_{90.5}Cu_{3.25}Y_{6.25}$, heat-treated $Mg_{90.5}Zn_{3.25}Y_{6.25}$, and heat-treated $Mg_{90.5}Ni_{3.25}Y_{6.25}$ exceeded the strength of the heat-resistant magnesium alloy WE54A-T6 (WE54A: Mg-5% Y-4% RE, T6: state treated through artificial aging effect after solution treatment), and the heat-resistant aluminum alloy A2219-T81 (A2219: Al-6% Cu-0.3% Mn-0.5% Zr, T81: state treated through artificial aging effect after solution treatment followed by 1% cold-rolling). Further at 598K, the proof stress of them was 100 MPa or more, keeping the high strength. At 623K, the heat-treated $Mg_{90.5}Ni_{3.25}Y_{6.25}$ alloy kept high strength, giving 100 MPa or higher proof stress, and the heat-treated $Mg_{90.5}Cu_{3.25}Y_{6.25}$ alloy showed as high as 143% of ductility.

From the above result, it can be said that the Mg-TM-Y alloy (TM: transition metal) prepared in the Example 3 is an Mg alloy having high specific strength within a wide range of room temperature to high temperatures.

A presumable reason of the above high strength of the alloy "sheet" in the Example 3 is that the hot-rolling brings Mg and (001) and (0018) planes of the long-period phase orient (forming texture) in parallel with the sheet plane so that the deformation in the tensile direction becomes difficult. The result of tensile test for a non-oriented as-rapidly cooled material also showed high strength, giving tensile strength of 300 MP because the long-period itself has high strength. The rapid cooling effect using a copper mold also contributes to the increase in strength to some extent. In addition to the above, hot-rolling presumably forms a texture to further increase the strength. The reason for high strength even in high temperature range is that the long-period phase itself endures high temperatures and that the texture remains even after heat treatment at 400° C. for 6 hours so that the high strength is attained similar to the case of room temperature. The heat treatment after rolling is critical, and without the heat treatment, the elongation at room temperature cannot improve. The elongation at room temperature is a phenomenon in which the heat treatment brings Mg to recovery and recrystallization to induce elongation. Although Mg is recovered, the long-period phase itself remains in a texture form even after the heat treatment at 400° C. as described above, the remained texture significantly contributes to the increase in strength.

Example 4

First, there were prepared ingots having the respective compositions given in Tables 4 to 6 through high frequency induction melting in an Ar gas atmosphere. The ingot was cut to prepare an extrusion billet in a shape of 29 mm in diameter and 65 mm in length.

Then, extrusion was given to the extrusion billet conducting preheating at 623K for 20 minutes, followed by extrusion at the respective extrusion ratios, extrusion temperatures, and extrusion speeds indicated in Tables 4 to 6. Thus extruded material was subjected to tensile test at the respective temperatures indicated in Tables 4 to 6. The result is indicated in Tables 4 to 6.

As seen in Tables 4 to 6, the magnesium alloy that forms the long-period stacking ordered structure phase has high yield strength.

The present invention is not limited to the above-described embodiments and examples, and various modifications can be possible within a range not departing from the spirit and scope of the present invention.

TABLE 4

Tensile characteristics of extrusion ingot of Mg—Ni—Y alloy

| | | | | Tensile temperature | | | | | |
|---|---|---|---|---|---|---|---|---|---|
| | Extrusion condition | | | Room temperature | | | 200°0 C. | | |
| Composition (at. %) | Extrusion temperature (° C.) | Extrusion ratio | Extrusion speed (mm/s) | Yield strength (MPa) | Tensile strength (MPa) | Elongation (%) | Yield strength (MPa) | Tensile strength (MPa) | Elongation (%) |
| $Mg_{93.5}Ni_3Y_{3.5}$ | 400 | 10 | 2.5 | 485 | 551 | 8.9 | 320 | 387 | 21.9 |
| $Mg_{89}Ni_4Y_7$ | 500 | 10 | 2.5 | 480 | 507 | 0.2 | 392 | 450 | 1.7 |
| $Mg_{93}Ni_3Y_4$ | 400 | 10 | 2.5 | 440 | 521 | 2.6 | 320 | 389 | 17 |
| $Mg_{94.5}Ni_3Y_{2.5}$ | 350 | 10 | 2.5 | 461 | 513 | 2.7 | 320 | 359 | 20.4 |
| $Mg_{94}Ni_{2.5}Y_{3.5}$ | 350 | 10 | 2.5 | 445 | 520 | 8.4 | 324 | 387 | 16.7 |
| $Mg_{94}Ni_3Y_3$ | 350 | 10 | 2.5 | 475 | 542 | 6.7 | 322 | 375 | 21.1 |
| $Mg_{91.5}Ni_4Y_{4.5}$ | 500 | 10 | 2.5 | 407 | 496 | 2.4 | 281 | 355 | 19.4 |
| $Mg_{92.5}Ni_{3.5}Y_4$ | 450 | 10 | 2.5 | 465 | 516 | 2.7 | 305 | 371 | 22.3 |
| $Mg_{92.5}Ni_4Y_{3.5}$ | 450 | 10 | 2.5 | 456 | 531 | 4.5 | 300 | 365 | 20.3 |
| $Mg_{92}Ni_{3.5}Y_{4.5}$ | 450 | 10 | 2.5 | 464 | 536 | 2.6 | 310 | 385 | 21.9 |
| $Mg_{92}Ni_4Y_4$ | 450 | 10 | 2.5 | 455 | 532 | 3.2 | 303 | 374 | 21.8 |
| $Mg_{93.5}Ni_{2.5}Y_4$ | 450 | 10 | 2.5 | 405 | 475 | 7.2 | 293 | 374 | 20.2 |
| $Mg_{93.5}Ni_{3.5}Y_3$ | 400 | 10 | 2.5 | 480 | 534 | 5.6 | 310 | 385 | 24 |
| $Mg_{93}Ni_{2.5}Y_{4.5}$ | 450 | 10 | 2.5 | 355 | 487 | 5.9 | 315 | 290 | 19.4 |
| $Mg_{93}Ni_{3.5}Y_{3.5}$ | 450 | 10 | 2.5 | 456 | 516 | 5.8 | 304 | 365 | 26 |
| $Mg_{95}Ni_2Y_3$ | 350 | 10 | 2.5 | 311 | 448 | 10.8 | 320 | 370 | 10 |
| $Mg_{92.5}Ni_3Y_{4.5}$ | 400 | 10 | 2.5 | 405 | 518 | 4 | 330 | 409 | 17 |
| $Mg_{90}Ni_4Y_6$ | 500 | 10 | 2.5 | 470 | 470 | 0.2 | 375 | 442 | 7.7 |
| $Mg_{96}Ni_2Y_2$ | 350 | 10 | 2.5 | 445 | 473 | 5.8 | 289 | 325 | 13.2 |
| $Mg_{97}Ni_1Y_2$ | 350 | 10 | 2.5 | 293 | 373 | 13.6 | 262 | 312 | 20.7 |

| | Tensile tempetature | | | | | | | | |
|---|---|---|---|---|---|---|---|---|---|
| | 250° C. | | | 300° C. | | | Result of 350° C. tensile test | | |
| Composition (at. %) | Yield strength (MPa) | Tensile strength (MPa) | Elongation (%) | Yield strength (MPa) | Tensile strength (MPa) | Elongation (%) | Yield strength (MPa) | Tensile strength (MPa) | Elongation (%) |
| $Mg_{93.5}Ni_3Y_{3.5}$ | 250 | 311 | 31.2 | 162 | 199 | 70 | 81 | 97 | 31.9 (stopped before completion) |
| $Mg_{89}Ni_4Y_7$ | 320 | 402 | 6.7 | 230 | 274 | 282 | 119 | 143 | 48.2 |
| $Mg_{93}Ni_3Y_4$ | | | | | | | | | |
| $Mg_{94.5}Ni_3Y_{2.5}$ | | | | | | | | | |
| $Mg_{94}Ni_{2.5}Y_{3.5}$ | | | | | | | | | |
| $Mg_{94}Ni_3Y_3$ | | | | | | | | | |
| $Mg_{91.5}Ni_4Y_{4.5}$ | | | | | | | | | |
| $Mg_{92.5}Ni_{3.5}Y_4$ | | | | | | | | | |

TABLE 4-continued

| Tensile characteristics of extrusion ingot of Mg—Ni—Y alloy |
|---|
| $Mg_{92.5}Ni_4Y_{3.5}$ |
| $Mg_{92}Ni_{3.5}Y_{4.5}$ |
| $Mg_{92}Ni_4Y_4$ |
| $Mg_{93.5}Ni_{2.5}Y_4$ |
| $Mg_{93.5}Ni_{3.5}Y_3$ |
| $Mg_{93}Ni_{2.5}Y_{4.5}$ |
| $Mg_{93}Ni_{3.5}Y_{3.5}$ |
| $Mg_{95}Ni_2Y_3$ |
| $Mg_{92.5}Ni_3Y_{4.5}$ |
| $Mg_{90}Ni_4Y_6$ |
| $Mg_{96}Ni_2Y_2$ |
| $Mg_{97}Ni_1Y_2$ |

15

TABLE 5

Tensile characteristics of extrusion ingot of Mg—Cu—Y alloy

| | Extrusion condition | | | Tensile temperature | | | | | |
|---|---|---|---|---|---|---|---|---|---|
| | | | | Room temperature | | | 200° C. | | |
| Composition (at. %) | Extrusion temperature (° C.) | Extrusion ratio | Extrusion speed (mm/s) | Yield strength (MPa) | Tensile strength (MPa) | Elongation (%) | Yield strength (MPa) | Tensile strength (MPa) | Elongation (%) |
| $Mg_{92.5}Cu_3Y_{4.5}$ | 500 | 10 | 2.5 | 310 | 441 | 7.8 | 303 | 405 | 17.6 |
| $Mg_{94}Cu_{2.5}Y_{3.5}$ | 500 | 10 | 2.5 | 305 | 410 | 7.6 | 281 | 365 | 17.6 |
| $Mg_{90}Cu_4Y_6$ | 500 | 10 | 2.5 | 375 | 526 | 3.9 | 371 | 456 | 13.9 |
| $Mg_{95}Cu_2Y_3$ | 500 | 10 | 2.5 | 303 | 398 | 10.7 | 272 | 353 | 19.4 |
| $Mg_{97}Cu_1Y_2$ | 350 | 10 | 2.5 | 276 | 363 | 12.5 | 245 | 334 | 18 |
| $Mg_{96}Cu_2Y_2$ | 350 | 10 | 2.5 | 330 | 414 | 6.3 | 305 | 359 | 13.6 |

TABLE 6

Tensile characteristics of extrusion ingot of Mg—Co—Y alloy

| | Extrusion condition | | | Tensile temperature | | | | | |
|---|---|---|---|---|---|---|---|---|---|
| | | | | Room temperature | | | 200° C. | | |
| Composition (at. %) | Extrusion temperature (° C.) | Extrusion ratio | Extrusion speed (mm/s) | Yield strength (MPa) | Tensile strength (MPa) | Elongation (%) | Yield strength (MPa) | Tensile strength (MPa) | Elongation (%) |
| $Mg_{97}Co_1Y_2$ | 350 | 10 | 2.5 | 315 | 326 | 2.3 | 269 | 299 | 11.8 |
| $Mg_{96}Co_2Y_2$ | 350 | 10 | 2.5 | 265 | 311 | 9.2 | 239 | 283 | 12.9 |

The invention claimed is:

1. A high-strength and high-toughness magnesium alloy comprising:

a atom % in total of at least one metal of Cu, Ni, and Co; and b atom % in total of at least one element selected from the group consisting of Y, Dy, Er, Ho, Gd, Tb, and Tm, wherein a and b satisfy the following formulae (1) to (3), $$0.2 \leqq a \leqq 10 \quad (1)$$

$$0.2 \leqq b \leqq 10 \quad (2)$$

$$2/3a - 2/3 < b, \quad (3)$$

said high-strength and high-toughness magnesium alloy has a long-period stacking ordered structure phase, and said high-strength and high-toughness magnesium alloy does not contain Zn.

2. The high-strength and high-toughness magnesium alloy according to claim 1, wherein said high-strength and high-toughness magnesium alloy has an α-Mg phase, and said α-Mg phase has a lamellar structure.

3. The high-strength and high-toughness magnesium alloy according to claim 1, wherein said high-strength and high-toughness magnesium alloy has a chemical compound phase.

4. The high-strength and high-toughness magnesium alloy according to claim 1, wherein said high-strength and high-toughness magnesium alloy is a magnesium alloy cast, and said magnesium alloy cast is heat-treated.

5. The high-strength and high-toughness magnesium alloy according to claim 4, wherein said high-strength and high-toughness magnesium alloy is a plastic work product obtained by carrying out plastic-working of said magnesium alloy cast.

6. A high-strength and high-toughness magnesium alloy comprising a plastic work product having a long-period stacking ordered structure phase, said plastic work product being manufactured by preparing a magnesium alloy cast comprising a atom % in total of at least one metal of Cu, Ni, and Co, and b atom % in total of at least one element selected from the group consisting of Y, Dy, Er, Ho, Gd, Tb, and Tm, while a and b satisfy the following formulae (1) to (3), then by cutting said magnesium alloy cast into a chip-shaped cast, and then by solidifying said cast by plastic-working, $$0.2 \leqq a \leqq 10 \quad (1)$$

$$0.2 \leqq b \leqq 10 \quad (2)$$

$$2/3a - 2/3 < b, \quad (3)$$

said high-strength and high-toughness magnesium alloy does not contain Zn.

7. A high-strength and high-toughness magnesium alloy comprising a plastic work product having a long-period stacking ordered structure phase, said plastic work product being manufactured by preparing a magnesium alloy cast comprising a atom % in total of at least one metal of Cu, Ni, and Co, and b atom % in total of at least one element selected from the group consisting of Y, Dy, Er, Ho, Gd, Tb, and Tm, while a and b satisfy the following formulae (1) to (3), then by carrying out plastic-working of said magnesium alloy cast, $$0.2 \leqq a \leqq 10 \quad (1)$$

$$0.2 \leqq b \leqq 10 \quad (2)$$

$$2/3a - 2/3 < b, \quad (3)$$

said high-strength and high-toughness magnesium alloy does not contain Zn.

8. The high-strength and high-toughness magnesium alloy according to claim 6, wherein said magnesium alloy cast is heat-treated.

9. The high-strength and high-toughness magnesium alloy according to claim 6, wherein said plastic work product is heat-treated.

10. The high-strength and high-toughness magnesium alloy according to claim 5, wherein said plastic work product has an α-Mg phase, and said α-Mg phase has a lamellar structure.

11. The high-strength and high-toughness magnesium alloy according to claim 5, wherein said plastic work product has a chemical compound phase.

12. The high-strength and high-toughness magnesium alloy according to claim 5, wherein said plastic-working includes at least one of rolling, extruding, ECAE, drawing, forging, pressing, form-rolling, bending, FSW working, and repeating thereof.

13. The high-strength and high-toughness magnesium alloy according to claim 5, wherein said plastic-working gives an amount of equivalent strain per at least one cycle thereof within the range of more than zero to not more than 5.

14. The high-strength and high-toughness magnesium alloy according to claim 1, said high-strength and high-toughness magnesium alloy comprising a powder, a sheet, or a thin wire, which is prepared by forming a liquid having a composition containing a atom % in total of at least one metal of Cu, Ni, and Co, and b atom % in total of at least one element selected from the group consisting of Y, Dy, Er, Ho, Gd, Tb, and Tm, wherein said liquid does not contain Zn, and wherein a and b satisfy the following formulae (1) to (3), $$0.2 \leqq a \leqq 10 \quad (1)$$

$$0.2 \leqq b \leqq 10 \quad (2)$$

$$2/3a - 2/3 < b, \text{ and} \quad (3)$$

then rapidly cooling said liquid to coagulate, said powder, sheet, or thin wire to give a crystal structure of a long-period stacking ordered structure phase.

15. The high-strength and high-toughness magnesium alloy according to claim 14, wherein said powder, sheet, or thin wire has an α-Mg phase, and said α-Mg phase has a lamellar structure.

16. The high-strength and high-toughness magnesium alloy according to claim 14, wherein said powder, sheet, or thin wire has a chemical compound phase.

17. The high-strength and high-toughness magnesium alloy according to claim 1, wherein said long-period stacking ordered structure phase kinks.

18. The high-strength and high-toughness magnesium alloy according to claim 1, wherein said magnesium alloy comprises d atom % in total of at least one element selected from the group consisting of La, Ce, Pr, Nd, Sm, Eu, Yb, and Lu, while said b and d satisfy the following formula (6), $$0.2 < b + d \leqq 15. \quad (6)$$

19. The high-strength and high-toughness magnesium alloy according to claim 18, wherein said b and d further satisfy the following formula (7), $$d/b \leqq 1/2. \quad (7)$$

20. The high-strength and high-toughness magnesium alloy according to claim 1, wherein said magnesium alloy comprises e atom % in total of at least one element selected from the group consisting of Zr, Ti, Mn, Al, Ag, Sc, Sr, Ca, Si, Hf, Nb, B, C, Sn, Au, Ba, Ge, Bi, Ga, In, Ir, Li, Pd, Sb, V, Fe, Cr, and Mo, while e satisfies the following formula (8), $$0 < e \leqq 2.5. \quad (8)$$

21. A method for manufacturing high-strength and high-toughness magnesium alloy according to claim 1, comprising the steps of: preparing a magnesium alloy cast containing a atom % in total of at least one metal of Cu, Ni, and Co, and b atom % in total of at least one element selected from the group consisting of Y, Dy, Er, Ho, Gd, Tb, and Tm, while a and b satisfy the following formulae (1) to (3); and preparing a plastic work product by carrying out plastic-working of said magnesium alloy cast, $$0.2 \leqq a \leqq 10 \quad (1)$$

$$0.2 \leqq b \leqq 10 \quad (2)$$

$$2/3a - 2/3 < b. \quad (3)$$

22. The high-strength and high-toughness magnesium alloy according to claim 21, further comprising the step of cutting said magnesium alloy cast between the step of preparing said magnesium alloy cast and the step of preparing said plastic work product.

23. The method for manufacturing high-strength and high-toughness magnesium alloy according to claim 21, wherein said magnesium alloy cast has a long-period stacking ordered structure phase.

24. The method for manufacturing high-strength and high-toughness magnesium alloy according to claim 21, wherein said plastic work product has a long-period stacking ordered structure phase.

25. The method for manufacturing high-strength and high-toughness magnesium alloy according to 23, wherein said plastic work product has an α-Mg phase, and said α-Mg phase has a lamella structure.

26. The method for manufacturing high-strength and high-toughness magnesium alloy according to claim 23, wherein said plastic work product has a chemical compound phase.

27. The method for manufacturing high-strength and high-toughness magnesium alloy according to claim 23, wherein said long-period stacking ordered structure phase kinks.

28. The method for manufacturing high-strength and high-toughness magnesium alloy according to claim 21, further comprising the step of conducting heat treatment of said magnesium alloy cast after the step of preparing said magnesium alloy cast.

29. The method for manufacturing high-strength and high-toughness magnesium alloy according to claim 21, further comprising the step of conducting heat treatment of said plastic work product after the step of preparing said plastic work product.

30. The method for manufacturing high-strength and high-toughness magnesium alloy according to claim 21, wherein said plastic-working includes at least one of rolling, extruding, ECAE, drawing, forging, pressing, form-rolling, bending, FSW working, and repeating thereof.

31. The method for manufacturing high-strength and high-toughness magnesium alloy according to claim 21, wherein said plastic working gives an amount of equivalent strain per at least one cycle thereof within the range of more than zero and not more than 5.

32. The method for manufacturing high-strength and high-toughness magnesium alloy according to claim 21, wherein the magnesium alloy comprises d atom % in total of at least one element selected from the group consisting of La, Ce, Pr, Nd, Sm, Eu, Yb, and Lu, while said b and d satisfy the following formula (6), $$0.2<b+d\leqq 15. \quad (6)$$

33. The method for manufacturing high-strength and high-toughness magnesium alloy according to claim 32, wherein said b and d further satisfy the following formula (7), $$d/b\leqq 1/2. \quad (7)$$

34. The method for manufacturing high-strength and high-toughness magnesium alloy according to claim 21, wherein said magnesium alloy comprises e atom % in total of at least one element selected from the group consisting of Zr, Ti, Mn, Al, Ag, Sc, Sr, Ca, Si, Hf, Nb, B, C, Sn, Au, Ba, Ge, Bi, Ga, In, Ir, Li, Pd, Sb, V, Fe, Cr, and Mo, while e satisfies the following formula (8), $$0<e\leqq 2.5. \quad (8)$$

35. A method for manufacturing high-strength and high-toughness magnesium alloy according to claim 1, comprising the steps of: preparing a liquid having a composition containing a atom % in total of at least one metal of Cu, Ni, and Co, and b atom % in total of at least one element selected from the group consisting of Y, Dy, Er, Ho, Gd, Tb, and Tm, while a and b satisfy the following formulae (1) to (3); forming a powder, a sheet, or a thin wire, having a crystal structure of a long-period stacking ordered structure phase, by rapidly cooling said liquid to coagulate, and solidifying said powder, sheet, or thin wire so that shear is applied thereto, $$0.2\leqq a\leqq 10 \quad (1)$$

$$0.2\leqq b\leqq 10 \quad (2)$$

$$2/3a-2/3<b. \quad (3)$$

* * * * *